US011052512B1

(12) United States Patent
Allison

(10) Patent No.: US 11,052,512 B1
(45) Date of Patent: Jul. 6, 2021

(54) ADJUSTABLE KNIFE SHARPENER AND CLAMPING ASSEMBLY

(71) Applicant: Clay A. Allison, Sante Fe, NM (US)

(72) Inventor: Clay A. Allison, Sante Fe, NM (US)

( * ) Notice: Subject to any disclaimer, the term of this patent is extended or adjusted under 35 U.S.C. 154(b) by 580 days.

(21) Appl. No.: 15/700,307

(22) Filed: Sep. 11, 2017

Related U.S. Application Data

(63) Continuation-in-part of application No. 14/542,057, filed on Nov. 14, 2014, now Pat. No. 10,131,028,
(Continued)

(51) Int. Cl.
*B24D 15/08* (2006.01)
*B24B 3/54* (2006.01)
*B25B 5/08* (2006.01)

(52) U.S. Cl.
CPC ..... *B24D 15/08* (2013.01); *B24B 3/546* (2013.01); *B25B 5/08* (2013.01)

(58) Field of Classification Search
CPC .. B24B 3/543; B24B 3/36; B24B 3/48; B24B 3/52; B24B 3/54; B24D 15/06; B24D 15/063; B24D 15/065; B24D 15/08; B25B 5/04; B25B 5/08; B23Q 16/001; B23Q 3/06; B23Q 3/104; B23Q 3/105
See application file for complete search history.

(56) References Cited

U.S. PATENT DOCUMENTS 364,090 A * 5/1887 Clayton ..... B25B 13/32 81/116
474,566 A * 5/1892 Rittenhouse ..... B25B 13/32 81/116

(Continued)

FOREIGN PATENT DOCUMENTS

CA 2331369 A1 11/1999
CA 2367189 A1 7/2002

(Continued)

OTHER PUBLICATIONS

Zhu et al. "Motion-Guided Mechanical Toy Modeling." Journal of ACM Transactoins on Graphics (TOG), vol. 31, Issue 6, Nov. 2012, Article No. 127. <http://audentia-gestion.fr/research.microsoft/toy.pdf>. (Year: 2012).*

(Continued)

*Primary Examiner* — Orlando E Aviles
*Assistant Examiner* — Joel D Crandall
(74) *Attorney, Agent, or Firm* — Finch & Maloney PLLC

(57) ABSTRACT

A clamping apparatus has first and second clamping members extending in an opposed, spaced-apart relation along a central axis from proximal end portions to distal end portions with inside surfaces of the clamping members facing each other. A gap between the proximal end portions is adjustable to releasably secure an object between the distal end portions. A clamp actuator has a handle and a wedge, moving the handle to a first handle position moves the wedge linearly along the clamp central axis in engagement with the inside surfaces of the proximal end portions to increase the gap. Moving the handle to the second handle position moves the wedge in an opposite direction along the central clamp axis, thereby permitting the gap to decrease. In embodiments, the clamping force is adjustable.

24 Claims, 24 Drawing Sheets

Related U.S. Application Data which is a continuation-in-part of application No. 13/889,393, filed on May 8, 2013, now Pat. No. 9,216,488.

(56) References Cited

U.S. PATENT DOCUMENTS

| | | | | | |
|---|---|---|---|---|---|
| 636,648 | A * | 11/1899 | Farmer | B25B 13/32 | 81/116 |
| 701,951 | A * | 6/1902 | Shirk | B25B 13/32 | 81/116 |
| 1,506,643 | A * | 8/1924 | Johnson | B25B 13/32 | 81/90.2 |
| 2,127,289 | A | 8/1938 | Corrall et al. | | |
| 2,142,105 | A | 1/1939 | Blankner | | |
| 2,157,816 | A | 5/1939 | Carosi | | |
| 2,191,899 | A | 2/1940 | Primak | | |
| 2,259,095 | A | 10/1941 | Aiello, Sr. | | |
| 2,370,908 | A | 3/1945 | Llorens | | |
| 2,397,256 | A | 3/1946 | Foster | | |
| 2,809,539 | A * | 10/1957 | Hennessy | G01B 5/12 | 408/1 R |
| 3,219,376 | A * | 11/1965 | Peters | B25J 1/04 | 294/115 |
| 3,630,391 | A * | 12/1971 | Wilson | B21D 43/10 | 414/744.8 |
| 4,216,627 | A | 8/1980 | Westrom | | |
| 4,217,735 | A | 8/1980 | McGeoch et al. | | |
| 4,441,279 | A | 4/1984 | Storm et al. | | |
| 4,471,951 | A | 9/1984 | LeVine | | |
| 4,512,112 | A | 4/1985 | LeVine | | |
| 4,538,382 | A | 9/1985 | Johannsen | | |
| 4,624,079 | A | 11/1986 | Bonapace | | |
| 4,714,239 | A | 12/1987 | LeVine | | |
| 4,731,953 | A | 3/1988 | Owen | | |
| 4,777,770 | A | 10/1988 | LeVine | | |
| 4,955,593 | A | 9/1990 | Yang | | |
| 5,185,958 | A | 2/1993 | Dale | | |
| 5,195,275 | A | 3/1993 | McLean | | |
| 5,318,004 | A * | 6/1994 | Peck | F41B 5/1469 | 124/35.2 |
| 5,363,602 | A | 11/1994 | Anthon et al. | | |
| 5,431,068 | A | 7/1995 | Alsch | | |
| 5,477,753 | A | 12/1995 | Branscum et al. | | |
| 5,906,534 | A | 5/1999 | Folkman et al. | | |
| 6,003,360 | A | 12/1999 | Runk et al. | | |
| 6,168,509 | B1 | 1/2001 | Presgrove | | |
| 6,505,871 | B2 * | 1/2003 | McCormick | B25J 15/028 | 294/119.1 |
| 6,579,163 | B1 | 6/2003 | Ross et al. | | |
| 6,659,439 | B1 | 12/2003 | Baumgartner et al. | | |
| 6,763,819 | B2 | 7/2004 | Eckert | | |
| 7,052,385 | B1 | 5/2006 | Swartz | | |
| 7,144,310 | B2 | 12/2006 | Longbrake | | |
| 7,413,504 | B2 | 8/2008 | Lytinas | | |
| 8,016,279 | B1 | 9/2011 | Su | | |
| 8,262,438 | B1 | 9/2012 | Allison et al. | | |
| 8,544,919 | B2 * | 10/2013 | Oh | A47J 43/283 | 294/209 |
| 8,794,612 | B2 | 8/2014 | Chuang | | |
| 9,216,488 | B2 | 12/2015 | Allison | | |
| 9,452,508 | B2 | 9/2016 | Beechinor et al. | | |
| 9,878,483 | B2 | 1/2018 | Leroux | | |
| 10,131,028 | B1 | 11/2018 | Allison | | |
| 10,744,614 | B1 | 8/2020 | Allison | | |
| 2002/0074705 | A1 * | 6/2002 | Marusiak | B23B 47/287 | 269/156 |
| 2004/0077299 | A1 | 4/2004 | Friel, Sr. | | |
| 2006/0086208 | A1 | 4/2006 | Gschwind, Sr. et al. | | |
| 2007/0249268 | A1 | 10/2007 | Swartz | | |
| 2008/0223101 | A1 * | 9/2008 | Moeck | B21D 43/006 | 72/306 |
| 2009/0183956 | A1 | 7/2009 | Berliant | | |
| 2010/0295227 | A1 | 11/2010 | Hung | | |
| 2011/0159791 | A1 | 6/2011 | Heng | | |
| 2011/0177764 | A1 | 7/2011 | Schwartz | | |
| 2013/0234382 | A1 | 9/2013 | Hofmann | | |
| 2014/0335765 | A1 | 11/2014 | Allison | | |
| 2020/0180116 | A1 | 6/2020 | Combs et al. | | |

FOREIGN PATENT DOCUMENTS

| | | | | |
|---|---|---|---|---|
| EP | 0910497 | A1 | 4/1999 | |
| JP | 52051661 | A * | 4/1977 | B25J 15/022 |
| WO | 9106403 | | 5/1991 | |
| WO | 2004037488 | A1 | 5/2003 | |
| WO | 2007048165 | A1 | 5/2007 | |

OTHER PUBLICATIONS

Ohira, Osahisa. Translation of JP52051661A. Accessed Mar. 31, 2020. J-Plat Pat. (Year: 1977).*

B&H Photo-Video-Pro Audio, "Ikan Elements Pinch Clamp," available at https://www.bhphotovideo.com/c/product/820612-REG/Ikan_ELE_PN_Elements_Pinch_Clamp.html (accessed Dec. 8, 2020).

Eastwood, "Pinch Weld Clamps," available at https://www.eastwood.com/pinch-weld-clamps.html?gclid=EAlalQobChMlqJnHqJy_7QIVy_rICh3WBg-_EAkYBiABEgloVvD_BwE (accessed Dec. 8, 2020).

* cited by examiner

ADJUSTABLE KNIFE SHARPENER AND CLAMPING ASSEMBLY

This application is a continuation in part of U.S. patent application Ser. No. 14/542,057 (filed on Nov. 14, 2014), which is a continuation in part of U.S. patent application Ser. No. 13/889,393 (filed on May 8, 2013); the contents of both applications are incorporated herein by reference in their entireties.

BACKGROUND

1. Field of the Invention

The present disclosure relates generally to clamping assemblies and knife sharpeners. More particularly the present disclosure relates to an adjustable clamping assembly and sharpening apparatus for cutting implements.

2. Description of the Prior Art

Available knife sharpening systems typically include a hand-held sharpening hone or block and a clamp used to hold a knife in a fixed position. In the art of knife sharpening, it is desirable to have the same angle between the hone or block and each side of the knife blade. The difficulty in doing so by hand resulted in the advance of clamps to hold a knife blade in a fixed position.

With the knife blade held in a clamp, the user slides the sharpening block at an angle across each side of the cutting edge of the knife. For a consistent angle on both sides of the knife blade, sharpening blocks may be attached to a rod that extends from the base of the clamp. Current knife sharpening clamps rely on a pivot screw that extends between an upper portion of the jaws to define a pivot point between the jaws. A spreading screw extending between the bottom of the jaws is adjusted to spread apart the lower portions of the jaws, causing the upper portions of the jaws to pivot about the pivot screw and pinch together to clamp a knife blade.

In many configurations, one of the jaws remains in a fixed position relative to the knife blade while the other jaw pivots during adjustment of the pivot screw and/or the spreading screw.

U.S. Pat. No. 7,144,310 to Longbrake discloses an adjustable knife sharpener apparatus. The apparatus includes a clamping mechanism having a first clamp member and a second clamp member for securing a knife blade therebetween. The first and second clamp members are coupled together via a screw, or any other suitable fastener. The screw extends through an aperture in the first clamp member and is threadably received in a tapped bore located in the second clamp member. A thumbscrew or any other suitable fastener is threadably received in a tapped bore located in the first clamp member. An end of the thumbscrew bears against a surface of the second clamp member and is received in a dimple or complementary depression to mitigate sidewise movement of the first and second clamp members relative to each other. Operating the thumbscrew increases or decreases the separation of the first and second jaws as needed to hold the knife blade.

U.S. Pat. No. 4,512,112 to LeVine discloses a sharpener clamp construction comprising first and second clamp members having first and second longitudinal axes and first and second ends, respectively. First and second clamp members at the first ends of the first and second clamp members, respectively, are for clamping a knife with a second longitudinal axis extending transversely to the first longitudinal axis. The LeVine patent further discloses first and second guide member means formed integrally with and extending outwardly from the first and second clamp members, respectively, at the second end. The first and second guide member means has a plurality of apertures at different distances from the second end for receiving a guide rod attached to a sharpener stone holder.

SUMMARY

The prior art clamping mechanisms of knife sharpeners have several disadvantages. Knife blades that do not have parallel faces are difficult to clamp because inside faces of the jaws or clamping members do not mate well with the faces of the blade. The poorly-clamped blade tilts to one side, resulting in the cutting edge being no longer perpendicular to the sharpening angle adjustments of the sharpener. As a result, opposite sides of the blade have largely different sharpening angles. The user must measure the difference in angles and compensate for the angle change when sharpening opposite sides of the knife blade. If these angles are not accounted for by the user, the knife blade is sharpened with uneven angles on each side of the blade.

Another deficiency of prior art clamping devices is that one side of the clamp has a fixed position. This fixed position assumes a pre-determined thickness of the knife blade for the cutting edge to be aligned along the centerline of the jig. When one side of the clamp is fixed, the centerline of a blade having a thickness that is different than the predetermined thickness is not aligned with the centerline of the jig. This again results in unequal sharpening angles on each side of the knife blade.

Another deficiency is that clamping assemblies of the prior art are not adequately adjustable to clamp cutting implements (e.g., knives) of different thicknesses. For example, clamping a large, thick knife and then clamping a small, thin knife may require cumbersome adjustments to the spacing between clamping members if the clamping assembly is adjustable at all. Inadequate adjustment in the clamping force can also result in a clamping force that is inappropriate for the particular knife or other cutting implement, such as a force that either mars the finish of a knife or does not securely hold the cutting implement during sharpening.

Additional disadvantages result from using screws to define the pivot point and to separate the ends of the clamping members. Screw adjustments require the user to have additional tools to operate and adjust the clamp. Also, the screws often protrude beyond the outside faces of the clamping members, limiting the minimum angle at which the sharpening abrasives can contact the knife blade. Further, clamping mechanisms with screws require several steps to clamp and unclamp a knife blade, which takes extra time.

Additional deficiencies of prior art sharpeners result from the configuration of guide rods that hold the sharpening stone. Some designs lack the ability to securely fix a guide rod in an adjustable fixed position where the guide rod is coupled to a stable base with a clamping mechanism. The prior art designs also lack the ability to repeatedly and verifiably control the depth and alignment of the knife blade with respect to the clamping assembly and the sharpening blocks.

Further, prior art knife sharpeners are also flimsy, limited in adjustment, and generally are not useful to sharpen a cutting edge with a consistent, repeatable angle between the hone and the blade. Prior art sharpeners also lack the ability for the user to finely adjust or determine the sharpening angle with the desired level of accuracy. Currently-available sharpeners also lack the ability to precisely achieve a sharpening angle below ten degrees as required for Japanese knives and the like.

Still further, existing sharpeners generally lack the ability to sharpen complex cutting edges, such as found on sport knives and barber's shears. Due to the complex cutting edge profile, the user resorts to guessing, becoming so adept at sharpening by hand that the process becomes somewhat precise, using an expensive professional sharpening service, or purchasing a very expensive machine designed to sharpen implements with complex cutting edge profiles.

Accordingly, a need exists for a knife sharpener with a clamping mechanism that provides better clamping of knife blades of various thicknesses and shapes. A need also exists for a sharpener useful with a variety of different cutting implements and that provides controlled, adjustable, and repeatable sharpening angles from one sharpening session to the next.

One aspect of the present disclosure is directed to a sharpener clamp for use with a variety of cutting implements. In one aspect of the present disclosure, an apparatus for sharpening a cutting implement held in a vertical plane between first and second clamping members extending above a base. The first and second clamping members each have top or distal end portions and bottom or proximal end portions. Vertical inside surfaces of the clamping members face each other and are substantially parallel to the vertical plane. A guide rod is pivotably attached to the base at a proximal end and has a distal end that extends above the base at an angle to the vertical plane. An abrasive implement holder is configured to slidably move along the guide rod.

In one embodiment, the abrasive implement holder has a body with a holder aperture therethrough. The holder aperture extends along a guide rod axis and is sized and configured to receive the guide rod. An adjustable face plate is pivotably connected to the body and defines a second angle with the guide rod axis, where pivoting the adjustable face plate changes the second angle.

In another embodiment, the distance between the proximal end of the guide rod and the vertical plane is adjustable. In one embodiment, the apparatus includes an angle adjustment assembly with at least one arm connected to the proximal end of a guide rod. A control gear is disposed in rotational engagement with the arm(s), where rotating the control gear changes the distance between the proximal end and the vertical plane.

In another embodiment, a universal joint is connected between the control arm and the proximal end of the at least one guide rod. In one embodiment, the universal joint is a ball-and-socket joint. In another embodiment, the universal joint has a shaft portion that threadably engages a bracket, where rotating the shaft member changes the distance between the proximal end of the guide rod and the vertical plane.

In another embodiment, a fulcrum is disposed between the first and second vertical inside surfaces. A wedge member is configured to move between the first clamping member and the second clamping member to change the gap between the top portions by pivoting the first clamping member about the fulcrum with respect to the second clamping member.

In another embodiment, the apparatus includes a straight-line clamp connected to the wedge member, where actuating the straight-line clamp moves the wedge member.

In another embodiment, the wedge member has gears for engaging a geared rotatable shaft or lever.

In another embodiment, one or both of the first vertical inside surface and the second vertical inside surface has a slot with a slot depth. The slot is sized and configured to movably engage the wedge member. In one embodiment, slot depth increases towards the first proximal end portion.

In another embodiment, the contact angle between the abrasive element holder and the vertical plane is adjustable to less than ten degrees. In another embodiment, the angle is adjustable to less than six degrees.

In another embodiment, the knife sharpener includes an inclinometer configured to display the angle with the vertical plane.

In another aspect of the present disclosure, an apparatus for sharpening a cutting implement held in a vertical plane includes a base assembly, a first clamping member pivotably supported by the base assembly and a second clamping member pivotably supported by the base assembly. The first and second clamping member each have an inside surface, a proximal portion, and a distal portion, where the inside surfaces face each other and are spaced apart from each other. The first clamping member and the second clamping member are each adapted to pivot first and second distal portions towards each other to thereby clamp a cutting implement therebetween. A clamping assembly is attached to the base assembly and includes a cam member movably supported by the base assembly, a follower assembly having a first follower end and a second follower end. The first follower end is disposed in operational engagement with the cam member and the second follower end is disposed in operational engagement with the first clamping member and the second clamping member. A handle is operatively connected to the cam member, where operating the handle moves the cam member, thereby moving the follower assembly and causing the first and second clamping members to pivot.

In one embodiment, the cam member is rotatable and has a cam shaft connected thereto. The cam member has an arcuate cam surface eccentric about the cam shaft axis, where the follower assembly is disposed in operational engagement with the arcuate cam surface.

In another embodiment, the cam member is slidably movable along a linear direction transverse to the follower assembly and has an inclined cam surface that is operationally engaged by the follower assembly.

In another embodiment, the apparatus includes a rod positioning assembly attached to the base assembly that includes a first arm mounted to the base assembly. The first arm is movable along a longitudinal direction of the first arm. The rod positioning assembly also has a second arm mounted to the base assembly. The second arm is adjacent the first arm and movable in a longitudinal direction parallel to the longitudinal direction of the first arm. A rod positioning lever is pivotably connected to the base assembly and operatively connected to the first arm and to the second arm. Pivoting the rod positioning lever causes the first arm to move in the longitudinal direction of the first arm and causes the second arm to move in the longitudinal direction that is parallel to the longitudinal direction of the first arm, but in a direction that is opposite of the direction of the first arm.

In another embodiment, the rod positioning assembly also includes a central pivot pin attached to the base assembly, where the rod positioning lever is pivotable about the central pivot pin. A first guide pin is connected to and extends from the first arm and engages the rod positioning lever to one side of the central pivot pin. A second guide pin is connected to and extends from the second arm and engages the rod positioning lever to an opposite side of the central pivot pin.

Pivoting the rod positioning lever about the central pivot pin moves the first arm in the longitudinal direction and moves the second arm in a second longitudinal direction.

In another embodiment, the follower assembly includes a follower disposed in contact with the cam member, a wedge member disposed in contact with the first proximal end portion of the first clamping member and the second proximal end portion of the second clamping members, and a compressible member disposed between the follower and the wedge member. The compressible member may be, for example, a spring, a compressible polymer, gas piston, or other resiliently compressible object.

In another embodiment, the base assembly has a base and a second base plate disposed in a spaced apart and substantially parallel relation to the base. The first arm, the second arm, and the rod positioning lever are each at least partially disposed between the base and the second base plate.

In another embodiment, the base assembly also has at least one support member having a proximal support member portion and a distal support member portion. The proximal support member portion is connected at a proximal end to the second base plate. The distal support member portion extends transversely from the second base plate and is pivotably connected to the first and second clamping members. In one embodiment, the base assembly also includes a riser block disposed between and attached to the second base plate and the support member(s). The riser block defines a cam member well sized to at least partially receive the cam member.

In another embodiment, the apparatus includes a first guide rod having a proximal end and a distal end, where the proximal end is pivotably attached to the first arm. A second guide rod has a proximal end and a distal end, where the proximal end is pivotably attached to the second arm. The apparatus also has one or more abrasive implement holder that is constructed to slidably move along the first guide rod and/or the second guide rod.

In another embodiment, the first inside surface of the first clamping member defines a first sloped proximal portion and the second inside surface of the second clamping member defines a second sloped proximal portion. The first sloped proximal portion and the second sloped proximal portion each extend and diverge away from each other. The follower assembly is disposed in operational engagement with and to cause pivotal movement of the first sloped proximal portion and the second sloped proximal portion.

In another aspect of the present disclosure, an apparatus for sharpening a cutting implement held in a plane includes a base assembly and first and second clamping members each pivotably supported by the base assembly. A wedge member is in movable contact with the distal portions of the first and second clamping members and adapted to cause pivotal movement of the first clamping member and the second clamping member. A handle operatively coupled to the wedge member is operable to move the wedge member. A rod positioning assembly is attached to the base assembly and includes a first arm mounted to the base assembly and movable parallel to a first arm longitudinal axis and a second arm mounted to the base assembly adjacent the first arm and movable parallel to the first arm longitudinal axis. A rod positioning lever is pivotably connected to the base assembly and operatively connected to the first arm and to the second arm, where pivoting the rod positioning lever moves the first arm along the first arm longitudinal axis and moves the second arm in a second direction parallel to the first arm longitudinal axis and opposite of the first direction. A first guide rod pivotably connected to the first arm and a second guide rod is pivotably connected to the second arm.

In another embodiment, a cam member is movably supported by the base assembly, a follower is disposed in operational engagement with the cam member, and a compressible member, such as a spring or compressible polymer, is disposed between the follower and the wedge member. The handle is connected to the cam member, where operating the handle moves the cam member, thereby displacing the wedge member and pivoting the first and second clamping members.

In one embodiment, the cam member is rotatably movable and has an arcuate cam surface eccentric about a cam shaft axis. The follower is disposed in operational engagement with the arcuate cam surface. In another embodiment, the cam member is slidably movable and has an inclined cam surface, where the follower is disposed in operational engagement with the inclined cam surface.

Another aspect of the present disclosure is directed to a sharpening apparatus. In one embodiment, the sharpening apparatus includes a base and a first clamping member and a second clamping member each extending along a central clamp axis and pivotably supported by the base. The first clamping member has a first inside surface, a first proximal end portion, and a first distal end portion. The second clamping member extends in opposed alignment with the first clamping member and has a second proximal end portion, a second distal end portion, and a second inside surface facing and spaced apart from the first inside surface. The first clamping member and the second clamping member are capable of pivoting to clamp a cutting implement between the first distal end portion and the second distal end portion. A cam assembly is attached to the base and includes a cam shaft extending along a cam axis, the cam shaft movable between a first cam position and a second cam position. A cam is attached to the cam shaft and a follower is disposed in operational engagement with the cam. A wedge is operatively coupled to the follower and disposed in movable engagement with the first proximal end portion of the first clamping member and the second proximal end portion of the second clamping member. A spring is disposed between the follower and the wedge. Moving the cam to the first cam position moves the wedge generally along the central clamp axis between and in engagement with the first proximal end portion and the second proximal end portion, thereby pivoting the first distal end portion and the second distal end portion towards each other. Moving the cam to the second cam position moves the wedge in an opposite direction generally along the central clamp axis, thereby enabling the first distal end portion and the second distal end portion to pivot away from each other.

In another embodiment, the sharpening apparatus includes a clamp adjustment assembly configured to selectively move the cam assembly along the central clamp axis. For example, the clamp adjustment assembly is useful to adjust the clamping force and/or the gap between the first distal end portion and the second distal end portion.

In some embodiments, the clamp adjustment assembly includes an adjustment body having a generally cylindrical shape and extending along an adjustment body axis parallel to and vertically spaced from the cam axis. The adjustment body defines an outside surface eccentric about the adjustment body axis and is rotatable about the adjustment body axis between a first adjustment position and a second adjustment position. A plurality of pins each extend between the outside surface of the adjustment body and the cam shaft. Rotating the adjustment body to the first position retracts the cam assembly from the first proximal end portion and the second proximal end portion. Rotating the adjustment body to the second position advances the cam assembly along the central clamp axis towards the first proximal end portion and the second proximal end portion.

In another embodiment, the sharpening apparatus includes a rod positioning assembly attached to the base. In one embodiment, the rod positioning assembly includes a first arm extending longitudinally along a first axis perpendicular to a vertical plane between the first clamping member and the second clamping member, where the first arm is mounted to the base assembly and movable along the first axis. A second arm extends longitudinally along a second axis parallel to the first axis, where the second arm is mounted to the base adjacent the first arm and movable along the second axis. A rod positioning lever is pivotably connected to the base and operatively connected to the first arm and to the second arm. Pivoting the rod positioning lever moves the first arm in a first direction along the first axis and moves the second arm in a second direction opposite of the first direction.

In some embodiments, the rod positioning assembly also includes a central pivot pin attached to the base, where the rod positioning lever is pivotable about the central pivot pin. A first guide pin extends from the first arm and engages the rod positioning lever to one side of the central pivot pin. A second guide pin extends from the second arm and engages the rod positioning lever to a second side opposite the central pivot pin from the first side.

In some embodiments, the base includes a base with a top surface and a second base plate disposed in a spaced apart and substantially parallel relation to the top surface of the base, where the first arm, the second arm, and the rod positioning lever are each at least partially disposed between the base and the second base plate.

In some embodiments, the base also includes at least one support member having a proximal support member portion and a distal support member portion, where the proximal support member portion is connected at a proximal end to the second base plate and the distal support member portion extends transversely from the second base plate and is pivotably connected to the first and second clamping members.

In another embodiment, the sharpening apparatus includes a riser block disposed between and attached to the second base plate and the support member(s). The riser block defines a cam well sized to at least partially receive the cam and defines a cam shaft opening to receive the cam shaft therethrough.

In some embodiments, the sharpening apparatus includes a first guide rod having a proximal end and a distal end, where the proximal end is pivotably attached to the base. A second guide rod has a proximal end and a distal end, where the proximal end is pivotably attached to the base. The apparatus also has one or more abrasive implement holders each constructed to slidably move along the first guide rod or the second guide rod.

In some embodiments, the first inside surface of the first clamping member defines a first sloped proximal end portion and the second inside surface of the second clamping member defines a second sloped proximal end portion diverging from the first sloped proximal end portion as the first sloped proximal end portion and the second sloped proximal end portion extend toward the base, where the wedge is disposed in sliding engagement with the first sloped proximal end portion and the second sloped proximal end portion.

In some embodiments, the cam is rotatable about the cam shaft axis and has an arcuate cam surface eccentric about the cam shaft axis and disposed in operational engagement with the follower.

In some embodiments, the cam is movable along the cam shaft axis and has an inclined cam surface disposed in operational engagement with the follower. In some embodiments, for example, the apparatus includes a straight-line actuator operatively coupled to the cam shaft and having a handle pivotable between a first handle position and a second handle position to advance or retract the cam along the cam shaft axis.

Another aspect of the present disclosure is directed to a clamping apparatus. In one embodiment, a clamping apparatus includes a first clamping member extending along a clamp central axis from a first proximal end portion to a first distal end portion and having a first inside surface. A second clamping member extends along the clamp central axis from a second proximal end portion to a second distal end portion in opposed alignment with the first clamping member. The second clamping member has a second inside surface spaced from and facing the first inside surface, where the second distal end portion is opposite the first distal end portion and the second proximal end portion is opposite the first proximal end portion. A gap between the first inside surface of the first proximal end portion and the second inside surface of the second proximal end portion is adjustable to releasably secure a cutting implement between the first inside surface of the first distal end portion and the second inside surface of the second distal end portion. The apparatus includes a clamp actuator with a handle and a wedge. The wedge is movable along the clamp central axis between the first clamping member and the second clamping member in response to the handle moving between a first handle position and a second handle position. Moving the handle to the first handle position moves the wedge along the clamp central axis in engagement with the first inside surface of the first proximal end portion and in engagement with the second inside surface of the second proximal end portion, thereby increasing the gap. Moving the handle to the second handle position moves the wedge in an opposite direction along the central clamp axis, thereby permitting the gap to decrease. For example, the first clamping member and second clamping member can be biased to return to the unclamped position by a spring located between the first and second clamping members or by gravitational forces.

In some embodiments, the clamp actuator is a straight-line clamp with the wedge movable generally linearly along the clamp central axis and the handle pivotable about a first axis perpendicular to the clamp central axis.

In other embodiments, the clamp actuator is a cam assembly with a cam and a follower operatively coupled to the wedge, wherein rotation of the cam moves the follower and wedge generally linearly along the clamp central axis. In some embodiments, the cam assembly further includes a cam shaft extending along a cam axis with the cam attached thereto. The cam shaft is rotatable between a first cam position and a second cam position, where the follower is disposed in operational engagement with the cam. The wedge is disposed in movable engagement with the first proximal end portion of the first clamping member and the second proximal end portion of the second clamping member. A spring or other resilient compressible member is disposed between the follower and the wedge. Moving the cam to the first cam position moves the wedge generally along the central clamp axis between the first clamping member and the second clamping member, thereby pivoting the first distal end portion and the second distal end portion towards each other. Moving the cam to the second cam position moves the wedge in an opposite direction along the clamp central axis.

In another embodiment, the clamping apparatus includes a clamp adjustment assembly configured to selectively change the position of the cam along the clamp central axis. In some embodiments, the clamp adjustment assembly includes an adjustment body with a generally cylindrical shape extending along an adjustment body axis parallel to and spaced from the cam axis, where the adjustment body defines an outside surface eccentric about the adjustment body axis, and where the adjustment body is rotatable about the adjustment body axis between a first adjustment position and a second adjustment position. A plurality of pins extends between the adjustment body and the cam shaft. Rotating the adjustment body to the first position retracts the cam from the first clamping member and the second clamping member and rotating the adjustment body to the second position advances the cam toward the first clamping member and the second clamping member.

In another aspect of the present disclosure, a method of sharpening a cutting implement includes the steps of providing a sharpening apparatus comprising a base assembly, first and second clamping members, a clamping assembly attached to the base assembly and operable to pivot the first and second clamping members; positioning the blade of a cutting implement in a plane between a first inside surface of the first clamping member and the second inside surface of the second clamping member; and operating the handle, thereby causing the first and second clamping members to clamp the blade.

In one embodiment, the method includes selecting the sharpener to include a rod positioning assembly attached to the base assembly, where the rod positioning assembly has a first arm mounted to the base assembly and movable parallel to a first axis, a second arm mounted to the base assembly adjacent the first arm and movable parallel to the first axis, and a rod positioning lever pivotably connected to the base assembly and operatively connected to the first arm and to the second arm. Pivoting the rod positioning lever moves the first arm in a first direction parallel to the first axis and moves the second arm in a second direction parallel to the first axis and opposite of the first direction. A first guide rod has a proximal end and a distal end, where the proximal end is pivotably attached to the first arm. A second guide rod has a proximal end and a distal end, where the proximal end is pivotably attached to the second arm. The apparatus has one or more sharpening blocks that are constructed to slidably move along the first guide rod and/or the second guide rod. The method also includes the step of operating the rod positioning lever, thereby setting a sharpening angle between the plane and the first and second guide rods, and the step of sliding the one or more sharpening block up and down along the first and second guide rods and in frictional engagement with the cutting implement.

In another embodiment, the sharpening angle is set between five and thirty-five degrees.

In another embodiment of the method, operating the handle rotates the cam member. In another embodiment, operating the handle slides the cam member.

A further aspect of the present disclosure is a method of sharpening a cutting implement where the cutting implement is held in a vertical plane and where an abrasive element holder is slidably moved along a guide rod in frictional engagement with the cutting implement.

In one embodiment, the method includes securing the cutting implement between a first distal end portion of the first clamping member and a second distal end portion of the second clamping member, where the first clamping member and the second clamping member extend from (e.g., above) a base member. A first angle is set between a guide rod and the cutting implement held in a plane between the first and second clamping members, where the guide rod has a proximal end attached to the base member at an adjustable distance from the vertical plane. A second angle is set between the sharpening bock and the guide rod. An abrasive implement holder slidably mounted to the guide rod is moved up and down along the guide rod and in frictional engagement with the cutting implement.

In another embodiment of the method, the securing step includes advancing a wedge member between the first clamping member and the second clamping member, thereby increasing a gap between a proximal end portion of the first clamping member and a proximal end portion of the second clamping member and causing the distal end portion of the first clamping member and the distal end portion of the second clamping member to engage and hold the cutting implement.

In another embodiment of the method, the first angle is set between five and fifteen degrees, between fifteen and twenty-five degrees, or between twenty-five and thirty-five degrees. In another embodiment of the method, the second angle is set between zero and forty-five degrees. In another embodiment, the second angle is set between forty-five and eighty degrees.

The figures depict various embodiments of the present disclosure for purposes of illustration only. Numerous variations, configurations, and other embodiments will be apparent from the following detailed discussion.

DETAILED DESCRIPTION

Embodiments of the present disclosure are illustrated in FIGS. 1-25. As discussed herein, terms referencing direction, such as upward, downward, vertical, horizontal, left, right, front, back, etc., are used for convenience to describe embodiments of a sharpener 10 when oriented vertically to hold a cutting implement 8 extending horizontally with the cutting edge up as shown in the Figures. Embodiments according to the present disclosure are not limited by these directional references and it is contemplated that sharpeners or clamping assemblies of the present disclosure could be used in any orientation, such as having the base mounted to a vertical surface.

Figure 1:
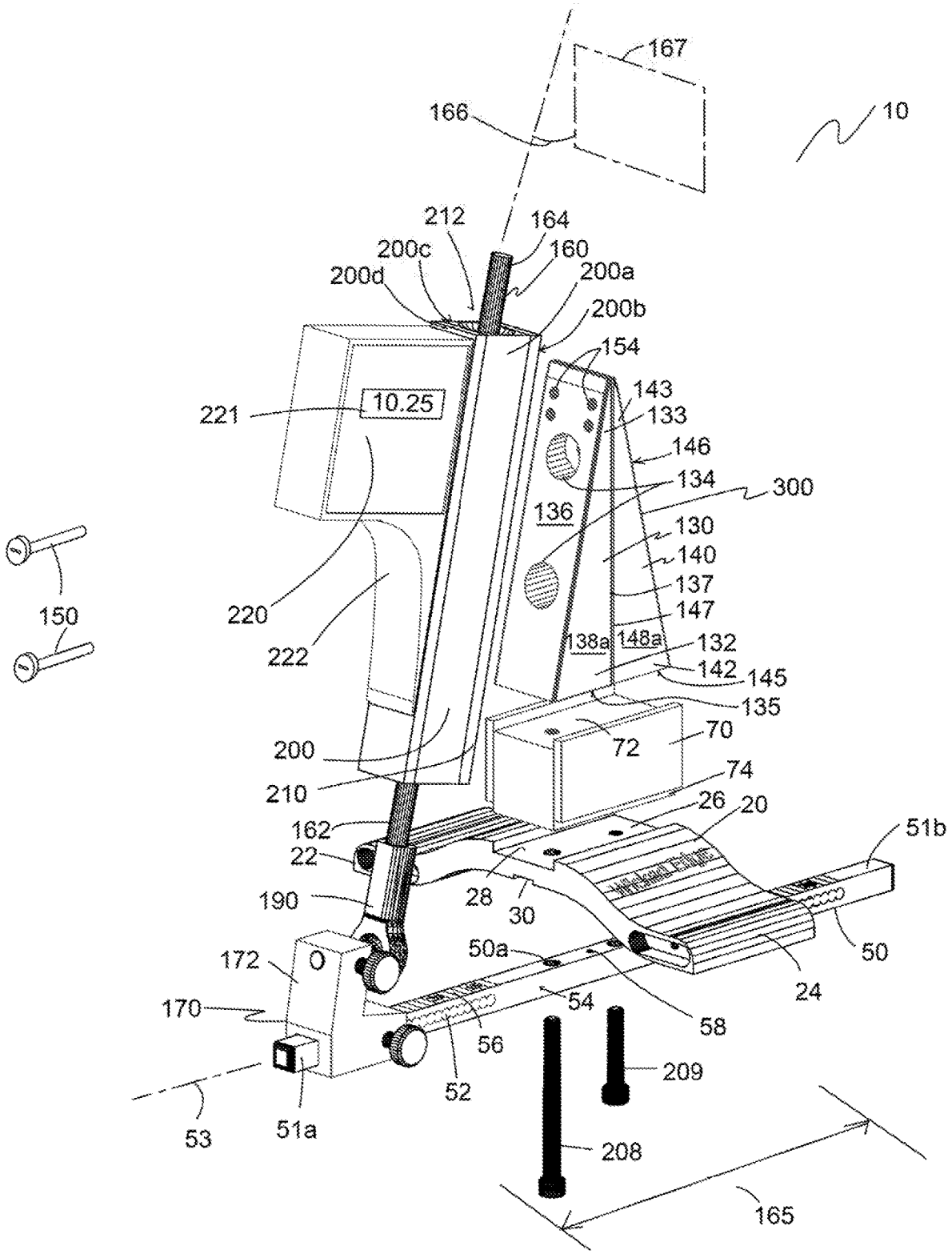
FIG. 1 is a perspective, exploded view of one embodiment of a knife sharpener of the present disclosure showing components of the apparatus.

FIG. 1 shows an exploded, perspective view of a sharpener 10 in accordance with an embodiment of the present disclosure. Sharpener 10 has a base 20, an angle adjustment assembly 170, an optional riser block 70 connected to base 20, a clamping assembly 300, a guide rod 160, and an abrasive element holder 200 slidably mounted to guide rod 160. One embodiment of angle adjustment assembly 170, discussed in more detail below, includes a base rod 50, pivot joint 190, and bracket 172. One embodiment of clamping assembly 300 includes a first clamping member 130, a second clamping member 140, and clamping fasteners 150.

A first fastener 208 extends through aligned apertures 50*a* in base rod 50, base 20, and riser block 70. First fastener 208 extends into and engages a proximal end portion 132 of first clamping member 130. A second fastener 209 extends through base rod 50 and base 20. Second fastener 209 extends into and engages riser block 70. First and second fasteners 208, 209 secure together base rod 50, base 20, riser block 70, and first clamping member 130.

In one embodiment, base 20 is a substantially-rectangular block with a first base end 22 and a second base end 24 positioned on opposite sides of a horizontal central axis 53 centered between lateral faces 138*a* &138*b*, 148*a* &148*b* of clamping members 130, 140, respectively (lateral faces 138*b* and 148*b* are not visible). Base 20 provides a common element to which the other components of knife sharpener 10 are joined. In one embodiment, a middle region 26 of base 20 defines an arch between first end 22 and second end 24. Middle region 26 has an optional upper slot 28 sized and configured to accept riser block 70. Optionally, riser block 70 is omitted and upper slot 28 accepts clamping members 130, 140. Upper slot 28 provides additional stability to sharpener 10 by preventing movement of riser block 70 and clamping members 130, 140 towards either of first base end 22 or second base end 24. Middle region also optionally has a lower slot or channel 30 sized and configured to accept base rod 50. Base 20 preferably has sufficient size and mass to provide a stable foundation for using knife sharpener 10. It is contemplated that base 20 may be a flat sheet of stone, a work bench, a metal block, or other suitable object with a flat surface and that provides a stable mounting platform to which components of knife sharpener 10 are attached. When base 20 is a slab of stone, for example, it has a slot to accept base rod 50 or has feet or other feature that allow sufficient space for base rod 50 to pass below base 20. In yet other embodiments, base rod 50 is attached to a top surface of base 20 and extends through a slot (not shown) in riser block 70.

Base rod 50 preferably has a square or rectangular cross-sectional profile and extends longitudinally along central axis 53 from a first end 51*a* to a second end 51*b*. Other cross-sectional geometries are also acceptable, depending on the method used to attach and adjust other components of angle adjustment assembly 170. In one embodiment, base rod 50 has a plurality of detents or recesses 52 along its length. Detents 52 are preferably in a side face 54 of base rod 50. Detents 52 allow the user to fix a bracket 172 or other connector at any one of several pre-determined locations. In one embodiment, base rod 50 has distance markings 56 to indicate the distance 165 between a reference point 58, such as the center point of base rod 50, and a proximal end of guide rod 160, which is discussed below. In one embodiment, each detent 52 corresponds to a change of one degree in a contact angle 166 between sharpening block 210 and cutting implement 8.

Base rod 50 is preferably secured to base 20 along central axis 53 and oriented perpendicularly to a vertical plane 167 extending through cutting implement 8 (shown in FIG. 2) held between clamping members 130, 140. As shown in FIG. 1, for example, base rod 50 is affixed to the underside of base 20 within lower slot 30 that runs across the width of base 20.

Riser block 70 is an optional accessory for sharpener 10 that raises clamping members higher above base 20 to achieve a smaller contact angle 166 between sharpening block 210 and cutting implement 8. Riser block 70 in one embodiment has an upper riser slot 72 that is sized and configured to accept clamping members 130, 140. Riser block also has a lower riser shoulder 74 sized and configured to fit into upper slot 28 of base 20. Upper riser slot 72 and lower riser shoulder 74 provide stability to sharpener 10 by preventing movement between adjacent components.

In one embodiment, first clamping member 130 and second clamping member 140 are each wedge-shaped blocks with respective bottom surfaces 135, 145, sloping outer surfaces 136, 146, vertical inner surfaces 137, 147, proximal end portions 132, 142, top portions 139, 149, and two lateral surfaces 138*a*, 138*b*, 148*a*, 148*b*. Preferably, first and second clamping members 130, 140 have the cross-sectional shape of a right triangle with an angle in a range of about five to fifteen degrees between sloping outer surfaces 136, 146 and vertical inner surfaces 137, 147, respectively. Having a wedge shape provides top portions 139, 149 with smaller profiles than the profiles of proximal end portions 132, 142. The smaller profiles at top portions 139, 149 allows sharpener 10 to be used to sharpen very small cutting implements since having thicker top portions 139, 149 would impede sharpening blocks 210 from approaching and being applied to a cutting edge located relatively close to top portions 139, 149 of clamping members 130, 140. Other configurations of first and second clamping members 130, 140 are also acceptable, such as an L-shaped bracket. In one embodiment, first and second clamping members are sized and shaped to permit a contact angle 166 below ten degrees and as small as five degrees.

In one embodiment, one or more apertures 134 extend through or partially through clamping members 130, 140. Clamping fasteners 150 extend horizontally through apertures 134 in first clamping member 130 and into apertures 144 (not visible) of second clamping member 140. Clamping fasteners 150 extend into and engage second clamping member 140 to fasten second clamping member 140 to first clamping member 130. Clamping fasteners 150 and first and second fasteners 208, 209 preferably are threaded machine screws, bolts, or the like. By tightening clamping fasteners 150, second clamping member 140 is drawn towards first clamping member 130 to engage cutting implement 8 and securely hold it in place with its blade in a vertical plane 167 (shown in FIGS. 2 & 3).

Still referring to FIG. 1, a plurality of apertures 134, 144 may be used at different vertical positions along clamping members 130, 140 to adjust the gap 307 (shown in FIG. 6) and angle between vertical surfaces 137, 147.

First clamping member 130 and second clamping member 140 are supported by riser block 70 with bottom surfaces 135, 145 positioned in upper riser slot 72 of base 20. If riser block 70 is not used, lower surfaces 135, 145 of clamping members 130, 140, respectively, are supported by base 20 and preferably positioned in an upper slot 28 of base 20.

Clamping members 130, 140 optionally include depth control apertures 154. Cutting implement 8 may be supported between clamping members 130, 140 on horizontal posts (not shown) that extend through depth control apertures 154. In this manner, cutting implement 8 is secured at a consistent vertical position between clamping members 130, 140 for each sharpening session. Clamping members 130, 140 are then drawn together by tightening clamping fasteners 150.

Alternate embodiments may use different systems for controlling the depth of cutting implement 8 between clamping members 130, 140. One example (not depicted) is a slidable shoulder located between clamping members 130, 140 that slides up and down. In one embodiment, slidable shoulder is a fulcrum block 304 that slides up and down clamping member 140 along a channel 330 in inside vertical face 140*a* (shown in FIG. 9 and discussed below).

One or more guide rods 160 are pivotably connected to base rod 50 or to base 20. Guide rods 160 are preferably rigid cylindrical rods made of metal with a proximal end 162 positioned towards base rod 50 and a distal end 164 extending above base 20. In one embodiment, proximal end 162 of one guide rod 160 is positioned towards a first end 51*a* of base rod 50 and a proximal end 162 of a second guide rod 160 (not shown) is mounted towards a second end 51*b* of base rod 50. The position of first guide rod(s) 160 relative to vertical plane 167 is preferably adjustable along base rod 50 or on base 20. Other shapes and materials of guide rod(s) 160 are acceptable provided that guide rod(s) 160 have the rigidity, strength, and other physical characteristics to deliver the desired level of precision positioning and adjustment.

Angle adjustment assembly 170 allows guide rod 160, and thus sharpening block 210, to move both parallel and perpendicular to a vertical plane 167 through cutting implement 8 (shown in FIGS. 2-3) to allow sharpening block 210 to continuously contact the cutting edge 9 of cutting implement 8. In one embodiment, angle adjustment assembly 170 connects guide rods 160 to base 20 with base rod 50. Contact angle 166 between sharpening block 210 and vertical plane 167 can be adjusted based on the position of bracket 172 along base rod 50 or on base 20. Angle adjustment assembly 170 enables the user to adjust a distance 165 between proximate end 162 of guide rod 160 and a reference point 58. For example, reference point 58 may correspond to the center of base rod 50 or to the horizontal position along base rod 50 of vertical plane 167 extending through cutting implement 8. By adjusting distance 165, contact angle 166 is defined between abrasive element holder 200 (and attached sharpening block 210) and cutting implement or vertical plane 167. Contact angle 166 may also correspond to the angle between guide rod 160 and vertical plane 167.

An abrasive element holder 200 is configured to slide along guide rod 160 via holder aperture 212 that extends through abrasive element holder 200 from end to end. Sharpening block 210 is removably attached to abrasive element holder 200, which is slidably mounted on guide rod 160. In one embodiment, abrasive element holder 200 has a substantially rectangular cross-sectional shape, therefore including four holder sides 200*a*, 200*b*, 200*c* (not visible). A sharpening block 210 with a grinding or honing material is affixed to one or more of holder sides 200*a*, 200*b*, 200*c*, 200*d*. When using multiple sharpening blocks 210, for example one on each side 200*a*-200*d*, abrasive element holder 200 may be rotated about guide rod 160 to select a honing material with the desired grit. Grinding or honing material may take any of a number of forms. Such honing material typically ranges from a coarse grit to a fine grit (for example, 80 to 1000 grit) and multiple honing materials are used in successive iterations during the sharpening process to achieve the desired sharpening effect.

In one embodiment, sharpening block 210 comprises a strap of leather or a synthetic material that is embedded with a diamond paste or other abrasive or polishing compounds. Similarly, diamond or polishing paste may be applied to the strap. Abrasive element holder 200 optionally has hand or finger depressions along opposite sides (e.g., 200*a*, 200*c*) that provide an ergonomic benefit as well as a functional benefit of protecting the user's fingers from the cutting edge 9 (shown in FIG. 3) of cutting implement 8.

In one embodiment, knife sharpener 10 includes an inclinometer 220. In one embodiment, inclinometer 220 has a digital display 221 and is affixed to or built into abrasive element holder 200. For example, in place of sharpening block 210 on holder side 200*d*, inclinometer 220 is removably attached using magnets, fasteners, hook-and-loop fasteners, clips, adhesive, or the like. As another example, components of inclinometer 200 (e.g., battery, digital display 221, electronics) are included in abrasive element holder 200 with digital display 221 along holder side 200*a*. Inclinometer 200 may alternately be affixed to abrasive element holder 200 using a frame 222 that supports inclinometer 220 around its perimeter. For example, frame 222 is configured to be inserted into guide slots (not shown) along abrasive element holder 200 or attach to abrasive element holder 200 using methods described above. An example of one acceptable inclinometer is the iGaging digital AngleCube, which measures an angle with respect to a reference surface (e.g., vertical surface 137) with an accuracy of +/−0.2 degree, precision of 0.1 degree, and resolution of 0.05 degree. Inclinometer 220 is useful to measure contact angle 166 between sharpening block 210 and cutting implement 8.

Figure 2:
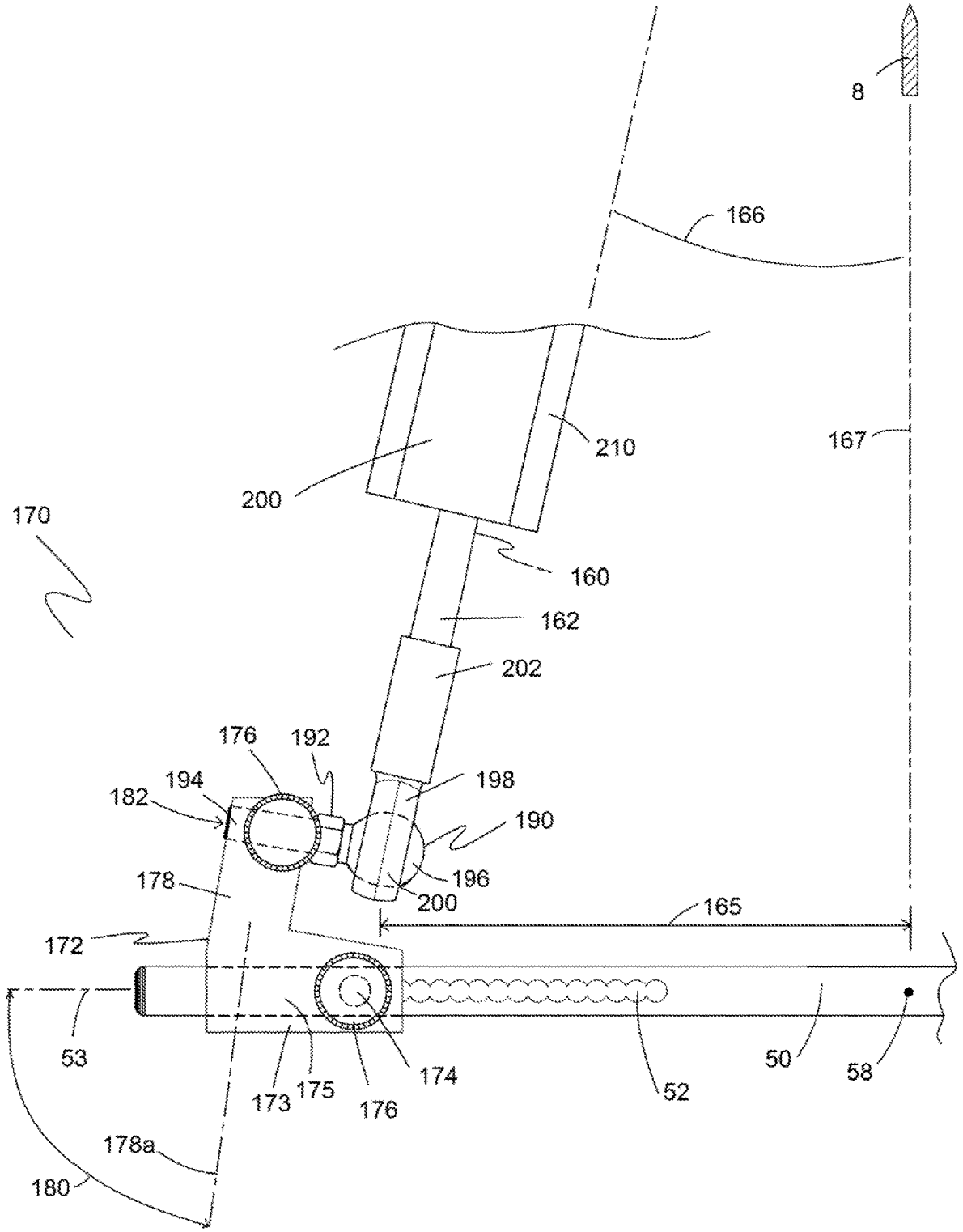
FIG. 2 is an enlarged side view of one embodiment of an angle adjustment assembly showing a guide rod pivotably connected to a base rod.

Referring now to FIG. 2, a side view is shown of one embodiment of angle adjustment assembly 170 of the embodiment of FIG. 1. Angle adjustment assembly 170 includes base rod 50, a bracket 172 adjustably mounted to base rod 50, and a universal or pivot joint 190 connected to bracket 172. Bracket 172 is preferably an L-shaped bracket with a horizontal portion 173 and an upright portion 178. Other shapes for bracket 172 are also acceptable where bracket 172 is configured to slidingly engage base 20 or base rod 50 and attach to universal joint 190. Horizontal portion 173 has a first channel or first opening 175 extending longitudinally therethrough. First opening 175 is sized and configured to receive base rod 50 for sliding movement of bracket 172 along base rod 50. A first adjustment opening 174 (preferably threaded) extends transversely through horizontal portion 173 of bracket 172. First adjustment opening 174 preferably extends transversely through first opening 175 and aligns with detents 52 along base rod 50. A threaded set screw 176, spring-biased pin, or the like extends through first adjustment opening 174 to engage detents 52 of base rod 50 and securely hold pivot joint 190 in a fixed position along length of base rod 50.

In other embodiments of knife sharpener 10, bracket 172 slides along a channel or track in or on base 20. For example, horizontal portion 173 of bracket 172 includes a flange that mates with a channel recessed into base 20.

Upright portion 178 extends upwardly from horizontal portion 173, along an upright axis 178*a* preferably oriented at an angle 180 of between seventy-five and eighty-five degrees to central axis 53. Angle 180 is not limited to these values. Upright portion 178 has a transverse second opening 182 extending therethrough, preferably perpendicular to upright axis 178*a* and aligned in the same general direction of base rod 50. Second opening 182 is preferably threaded and accepts a stem portion 194 of pivot joint 190.

In one embodiment, pivot joint 190 is a ball-and-socket joint, universal joint, coupling, or the like that permits proximal end 162 of guide rod 160 to pivot freely in any direction. When pivot joint 190 is a ball-and-socket joint, a first part 192 of pivot joint 190 has a stem portion 194 that is received in second opening 182 of bracket 172 and terminates in a sphere or ball 196 at its opposite end. A second part 198 has a socket portion 200 at one end with an opening that receives ball 196. Second part 198 has a rod connector 202 opposite of socket portion 200 to attach proximal end 162 of guide rod 160. Rod connector 202 may be a hollow cylindrical sleeve, a threaded rod, a coupler, or other connector shaped and configured to accept and retain proximal end 162 of guide rod 160.

By advancing threaded stem portion 194 into or out of second opening 182, proximal end 162 of guide rod 160 moves closer or farther away from vertical plane 167. Thus, the user may finely and precisely adjust contact angle 166 between sharpening block 210 and vertical plane 167. Preferably, stem portion 194 is threaded and has a hexagonal recess in one end to receive hex-wrenches for adjusting the position of stem portion 194 relative to vertical plane 167. In one embodiment, a 180° turn of threaded stem portion 194 advances pivot joint 190 towards or away from vertical plane 167 to cause a change in contact angle 166 of about 0.5° between sharpening block and cutting implement 8. By rotating stem portion 194 in smaller increments (e.g., 5°, 10°, or 15°) the user may achieve highly precise adjustment of contact angle 166. The position of stem portion 194 may be fixed by tightening a set screw 176 extending transversely through upright portion 178 and contacting stem portion 194. In other embodiments, second opening 182 is not threaded and receives a smooth stem portion 194.

Figure 3:
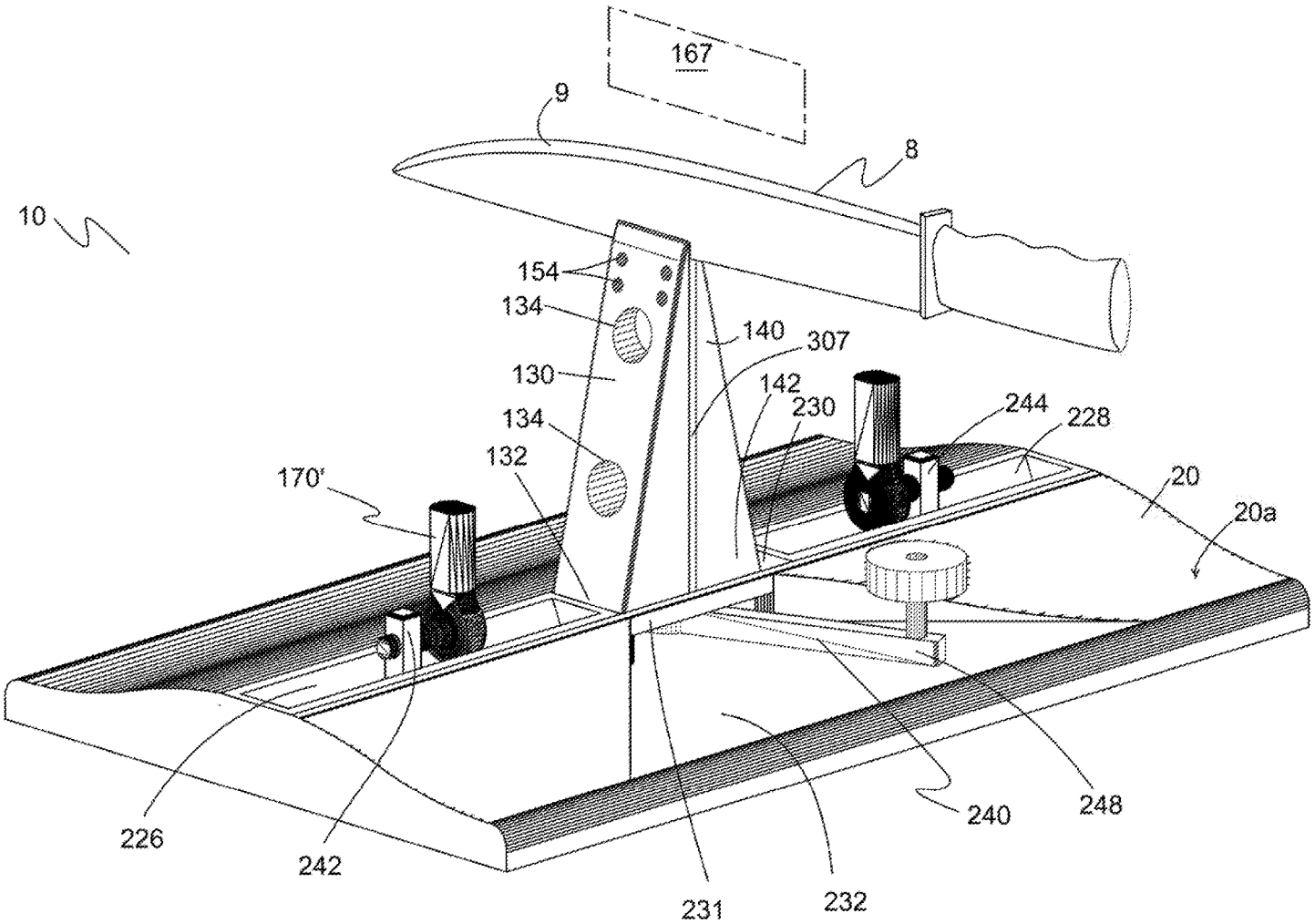
FIG. 3 is a perspective view of another embodiment of a knife sharpener of the present disclosure showing a knife held between first and second clamping members and one embodiment of an angle adjustment assembly.

Turning now to FIG. 3, a perspective view illustrates another embodiment of sharpener 10 with base 20, cutting implement 8 held in gap 307 between clamping members 130, 140, vertical plane 167 extending through cutting implement 8, and another embodiment of angle adjustment assembly 170' that includes a control gear 246 (shown in FIG. 4 and discussed below). For clarity of illustration, guide rods 160 and abrasive element holders 200 are not shown. Base 20 has a longitudinal first arm recess 226, a longitudinal second arm recess 228, a block recess 230, and a lever recess 232. First and second arm recesses 226, 228 are disposed in surface 20*a* of base 20 and preferably have a generally trapezoidal cross-sectional shape. First and second arm recesses 226, 228 are sized and configured to receive first and second arms 242, 244, respectively. A block recess 230 is disposed in top surface 20*a* of base 20 to accept and guide proximal end portions 132, 142 of clamping members 130, 140, respectively, and defines a block bridge 231. One of clamping members 130, 140 is secured to a block bridge 231. For example, fasteners (not shown) extend vertically through block bridge 231 from below and into lower end 132 of first clamping member 130 to secure clamping member 130 to base 20. Second clamping member 140 is attached to first clamping member 130 by clamping fasteners 150 (shown in FIG. 1) that extend horizontally through clamping openings 134 in first clamping member 130 and engage second clamping member 140. Second clamping member 140 is capable of sliding horizontally within block recess 230 while being fixed to first clamping member 130 with clamping fasteners 150. First clamping member 130 may alternately be welded to base 20 or fixed using other methods.

A lever recess 232 extends through top surface 20*a* of base 20 and tunnels below block bridge 231, where lever recess 232 communicates with first arm recess 226 and second arm recess 228. First arm 242 and second arm 244 extend from first and second arm recesses 226, 228, respectively, into lever recess 232 below block bridge 231. First and second arms 242, 244 move longitudinally along first and second arm recesses 226, 228, respectively, due to engagement with a control gear 246 (not visible), which is discussed in more detail below.

Figure 4:
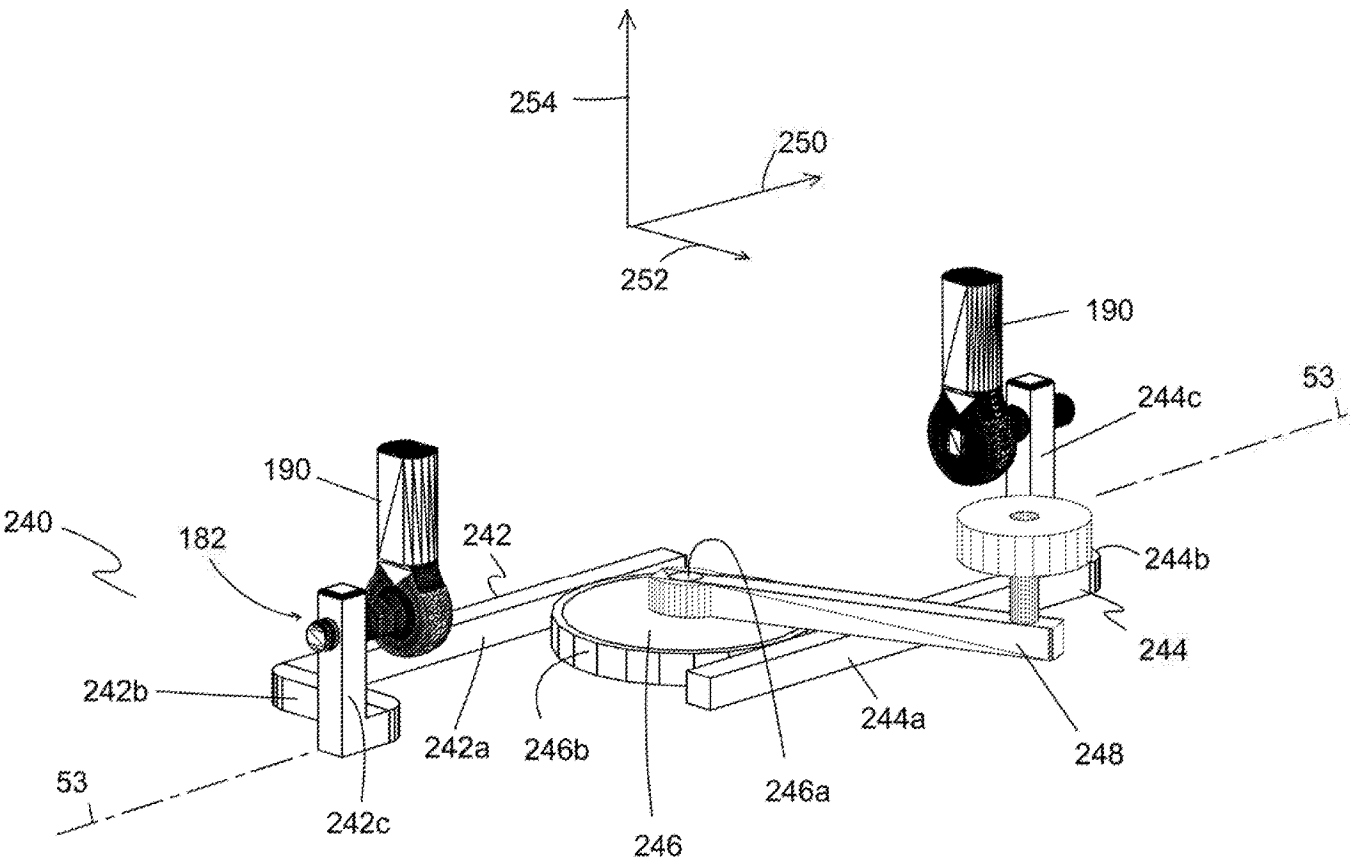
FIG. 4 is a perspective view of one embodiment of an angle adjustment assembly showing a control gear engaging first and second arms.

Referring now to FIG. 4, an embodiment is illustrated of rod positioning assembly 240 with control gear 246. Rod positioning assembly 240 has a first arm 242, second arm 244, control gear 246, and rod positioning lever 248 fixedly attached to control gear 246. First arm 242 has a longitudinal stem portion 242*a* extending parallel to a first axis 250, a beam portion 242*b* extending from the stem portion 242*a* parallel to a second axis 252 transverse to the first axis 250, and an upright portion 242*c* extending parallel to a third axis 254 transverse to the second axis 252 and to the first axis 250. Preferably, first axis 250, second axis 252, and third axis 254 correspond to X-, Y-, and Z-axes, respectively. Thus, beam portion 242*b* extends in a Y-direction and defines an L with stem portion extending in an X-direction; upright portion 242*c* extends in a Z-direction and defines an L with beam portion extending in the Y-direction. Second arm is similarly configured with stem portion 244*a*, beam portion 244*b*, and upright portion 244*c*. This preferred configuration enables stem portions 242*a*, 244*a* to engage opposite sides of control gear 246 while also enabling upright portions 242*c*, 244*c* to be aligned along a central axis 53 with center 246*a* of control gear 246 and clamping members 130, 140. Upright portions 242*c*, 244*c* are each coupled to pivot joints 190 by openings 182 (preferably threaded) similar to those in brackets 172 discussed above. Other configurations of first arm 242 and second arm 244 are acceptable, preferably provided that pivot joints 190 align and move along or parallel to central axis 53 in response to engagement with control gear 246.

As the user pivots rod positioning lever 248 about center 246*a* of control gear 246, control gear 246 rotates in engagement with first and second arms 242, 244, causing their longitudinal movement along central axis 53 towards or away from vertical plane 167 and clamping members 130, 140 (shown in FIG. 3). In one embodiment, control gear 246 is a toothed wheel that engages respective recesses or openings (not shown) on first and second arms 242, 244. Alternately, control gear may utilize an outer surface 246*b* having sufficient frictional engagement with first and second arms 242, 244 to cause their movement. In other embodiments, each of first and second arms 242, 244 has its own control gear 246 for independent movement of arms 242, 244.

Figure 5B:
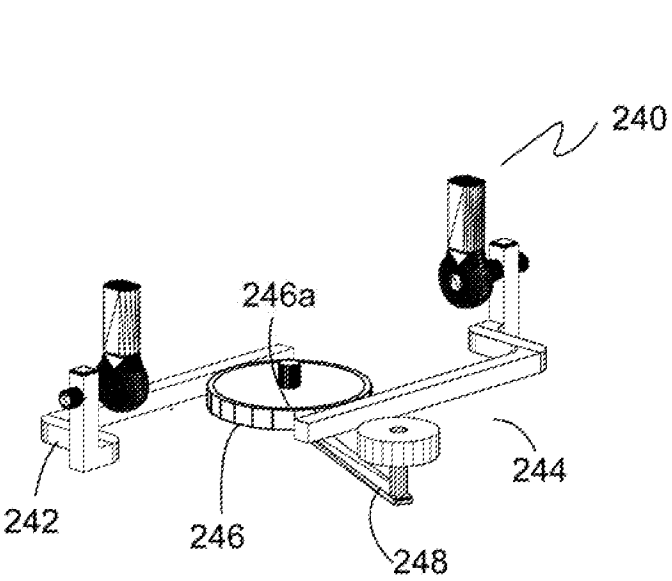
FIGS. 5A and 5B are perspective views of the angle adjustment assembly of FIG. 4 shown in a first position and a second position, respectively.
Figure 5A:
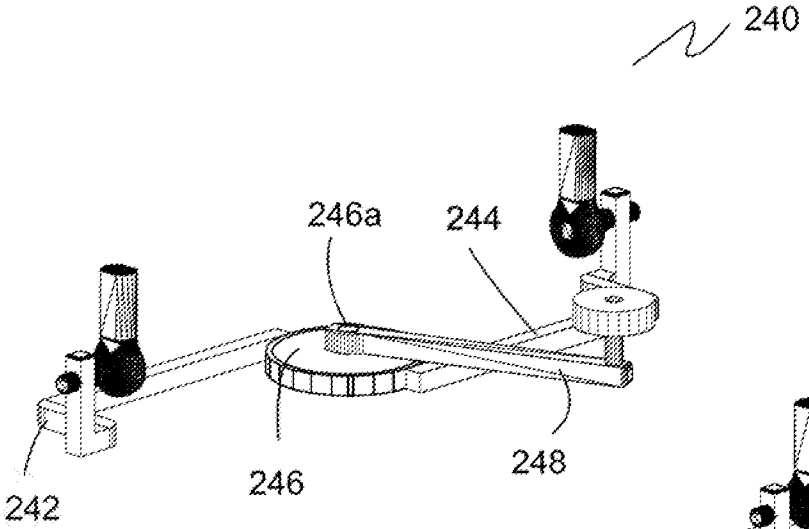

As shown in FIG. 5A, for example, an embodiment of rod positioning assembly 240 is illustrated with rod positioning lever 248 in a first position. With rod positioning lever 248 in its first position, control gear 246 causes first and second arms 242, 244 to be positioned away from center 246*a* of control gear 246. Preferably, center 246*a* of control gear 246 is positioned directly below and in vertical plane 167 through cutting implement 8 (shown in FIG. 2). As shown in FIG. 5B, for example, rod positioning lever 248 is in a second position, where control gear 246 causes first and second arms 242, 244 to be positioned closer to center 246*a* of control gear 246.

In one embodiment, rod positioning assembly 240 is configured with detents, notches, or other structure on control gear 246 and/or rod positioning lever 248 that indicates to the user visually, audibly, and/or tactilely that movement has occurred between each pre-determined incremental distance between pivot joints 190 and clamping members 130, 140.

Figure 6:
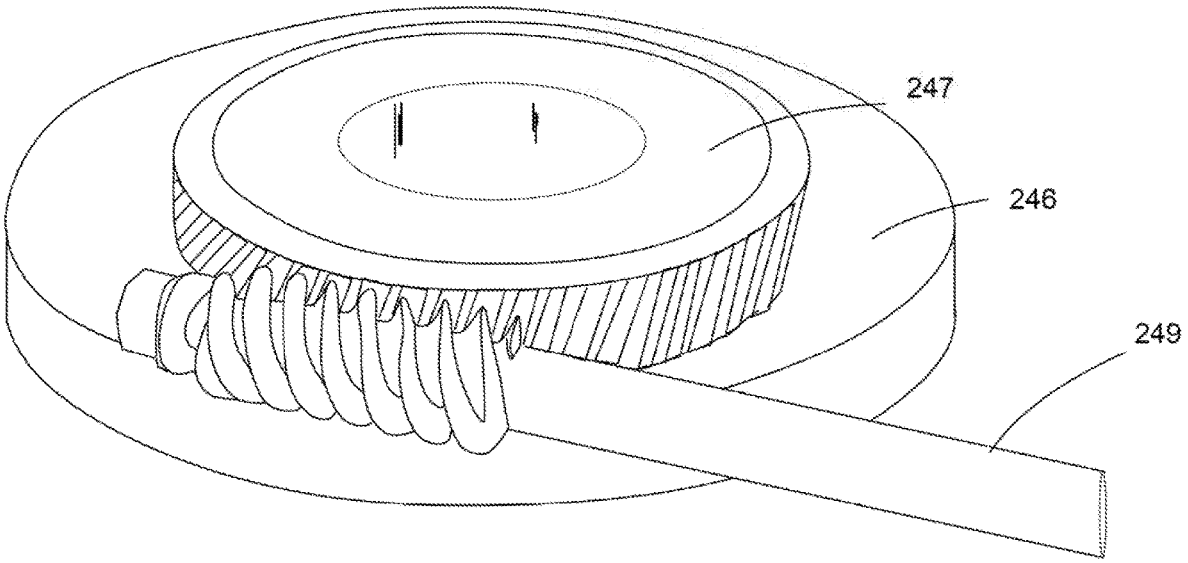
FIG. 6 is a perspective view of a worm-drive gear used with one embodiment of an angle adjustment assembly in accordance with an embodiment of the present disclosure.

In other embodiments of rod positioning assembly 240, as illustrated in FIG. 6, for example, control gear 246 is rotated by engagement between a worm-drive gear 249 and a drive gear 247. Drive gear may be attached to or formed as part of control gear 246. For example, worm-drive gear 249 and drive gear 247 are helical gears, where worm-drive gear engages drive gear 249 substantially at ninety degrees to an axis of rotation 251 of drive gear 249. In yet other embodiments, the user's hand contacts control gear 246 to rotate it. For example, control gear 246 is coupled to a second wheel or disk (not shown) that the user rotates to rotate control gear 246. Second wheel may engage control gear 246 to cause it to rotate, such as when control gear 246 and second wheel are both toothed gears. As another example, second wheel is a disk larger than control gear 246 and that extends through sharpener housing 260 instead of rod positioning lever 248.

Figure 7:
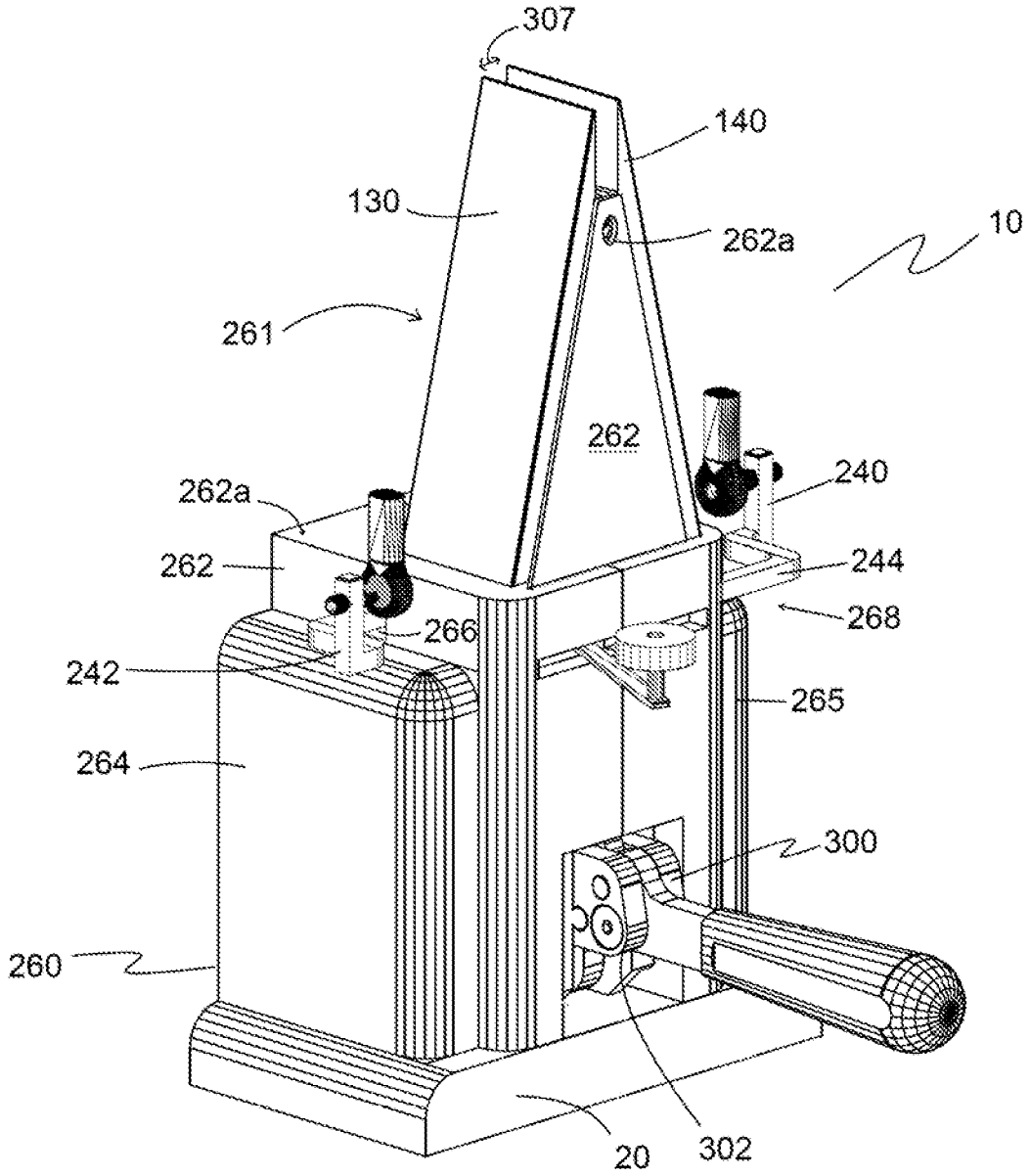
FIG. 7 is a perspective view of another embodiment of a knife sharpener of the present disclosure shown with a housing and embodiments of an angle adjustment assembly and a clamping assembly.

Referring now to FIG. 7, a perspective view is illustrated of another embodiment of knife sharpener 10 with base 20, rod positioning assembly 240, sharpener housing 260, and another embodiment of clamping assembly 300 that includes first and second clamping members 130, 140 and straight-line clamp 302. Sharpener housing 260 is preferably made of metal and encloses a major portion of clamping assembly 300 and rod positioning assembly 240. Sharpener housing 260 protects moving parts of sharpener 10 and is an extension of base 20 for attachment of components. Sharpener housing 260 optionally includes front cover plate 262 and rear cover plate 261 to partially conceal gap 307 between first and second clamping members 130, 140.

In one embodiment, front cover plate 262 and rear cover plate 261 are fixed to housing 260 and are attached to clamping members 130, 140 by a fastener, pin, rod or the like (not shown) that extends through plate opening 262*a* and fulcrum blocks 304, 306 (shown in FIG. 8 and discussed below.) Thus, clamping blocks 130, 140 have a fixed overall vertical position and have the ability to pivot, as discussed below.

In one embodiment, sharpener housing 260 has a substantially rectangular main housing body 262 with one or more side openings 263 (not visible) for access to moving parts of clamping assembly 300 and gear assembly 240. Main housing body 262 is preferably affixed to base 20 with fasteners (not shown). Side housing covers 264, 265 are preferably removably or hingedly attached to main housing body 262. Side housing covers 264, 265 are rectangular box-like covers, but may also have the form of a door or substantially planar panel. First arm 242 extends through a first arm aperture 266. Second arm 244 extends through a second arm aperture 268 (not visible). First and second clamping members 130, 140 are disposed over top opening 270 (not visible) through a top 262*a* of main housing body 262.

In one embodiment, first clamping member 130 is secured to housing and second clamping member 140 is attached to first clamping member via fulcrum blocks 304, 306 disposed connected to first and second clamping members, respectively, and discussed in more detail below. In another embodiment, riser block 70 is attached to top 262*a* of main housing body 262 and has an opening therethrough for wedge member 320. With riser block 70, first clamping member 130 is attached to riser block 70 with fasteners and second clamping member 140 is attached to first clamping member via fulcrum blocks 304, 306.

Figure 8:
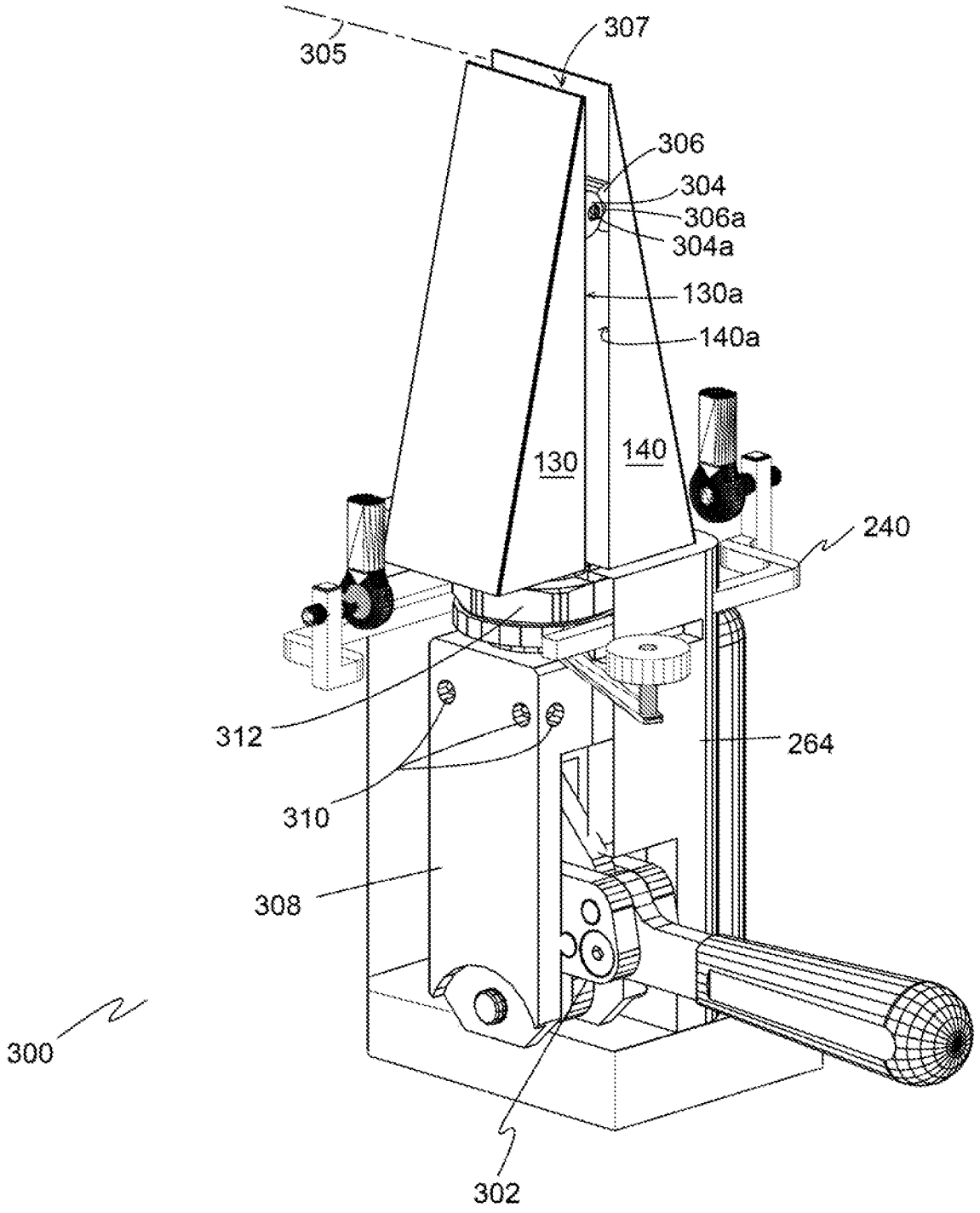
FIG. 8 is a perspective, partial cut-away view of the knife sharpener of FIG. 6 showing the clamping assembly and angle adjustment assembly.

Referring now to FIG. 8, a perspective view illustrates clamping assembly 300, rod positioning assembly 240, and portions of housing 264. Clamping assembly 300 includes first clamping member 130, second clamping member 140, and straight-line clamp 302. One or more fulcrum blocks 304 are disposed between first clamping member 130 and second clamping member 140. In one embodiment, fulcrum block(s) 304 extends from an inside surface 130*a* of first clamping member 130 towards second clamping member 140. Similarly, second fulcrum block(s) 306 may also extend from an inside surface 140*a* of second clamping member 140 towards first clamping member 130. In one embodiment, a single fulcrum block 304 is used. For example, fulcrum block 304 may be one or more protrusions from inside surface 130*a* of first clamping member 130, such as block having a rectangular, triangular, or rounded cross-sectional profile. Fulcrum block 304 may also be distinct from or removably attached to first clamping member 130 or second clamping member 140.

In one embodiment, fulcrum blocks 304, 306 have fulcrum openings 304*a*, 306*a* that extend parallel to a central cutting implement axis 305. Fulcrum blocks 304, 306 preferably overlap or alternate with one another where fulcrum openings 304*a*, 304*b* are aligned. Like a hinge, a pin, screw, bolt, or other connector extends through openings 304*a*, 304*b* of fulcrum blocks 304, 306 so that clamping members 130, 140 pivot about openings 304*a*, 304*b*, respectively, in response to operation of straight-line clamp 302, which is discussed below. Fulcrum blocks 304, 306 preferably are shaped as solid protrusions with a rounded or semi-circular profile, but other shapes and forms are also acceptable provided that they permit clamping members 130, 140 to pivot about fulcrum block(s) 304, 306, respectively. For example, one or both of fulcrum blocks 304, 306 may be a tab, plate, or other structure that permits hinged or pivoting movement.

Fulcrum block(s) 304 and/or 306 define a gap 307 between clamping members 130, 140. Gap 307 is measured between inside surfaces 130, 140*a* when inside surfaces 130*a*, 140*a* are parallel to each other. Gap 307 is preferably adjustable using a set screw to adjust the distance that fulcrum blocks 304, 306 extend from inside surfaces 130*a*, 140*a*, respectively.

Figure 9:
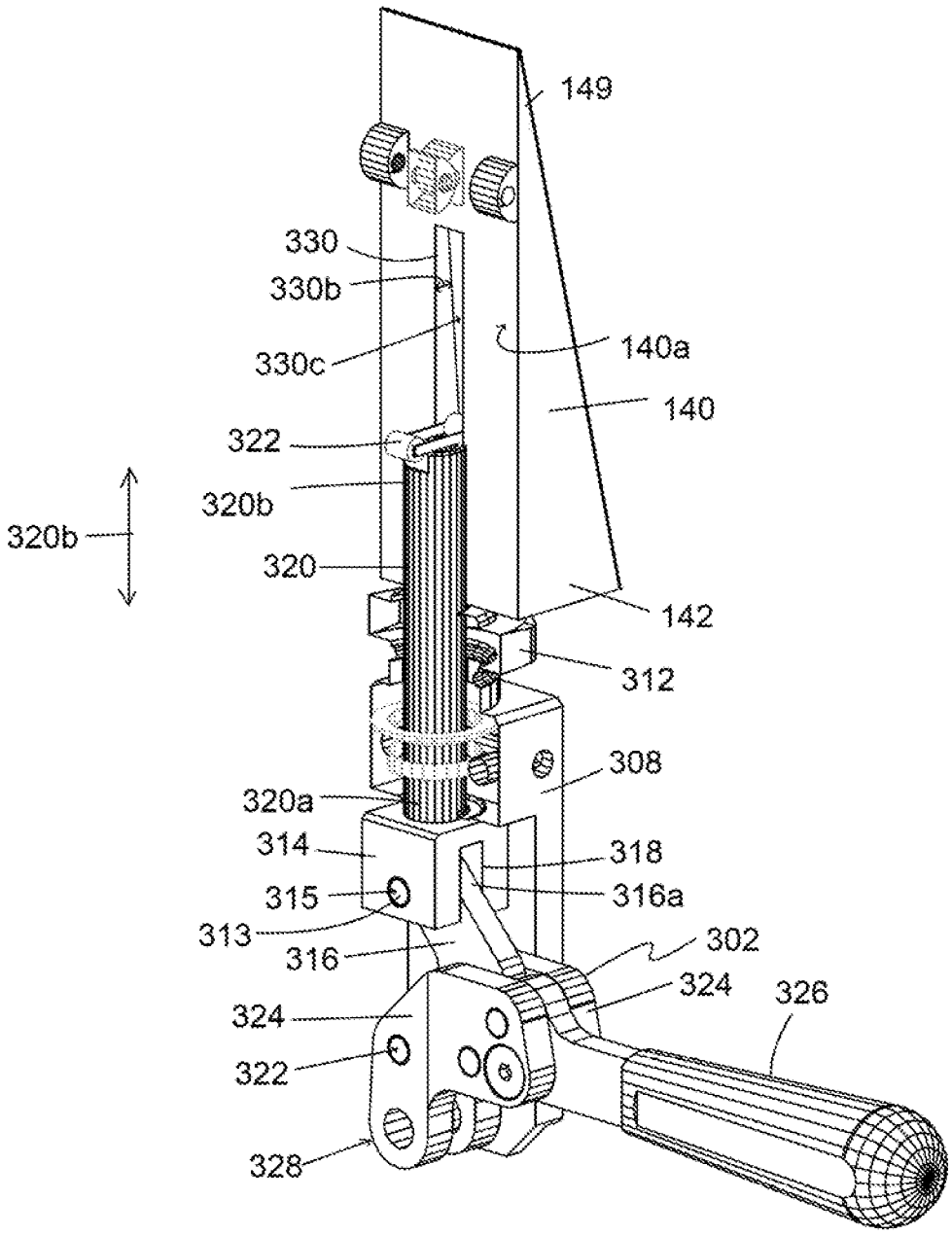
FIG. 9 is a perspective, partial cut-away view of the clamping assembly of FIG. 7 showing the wedge member and straight-line clamp.

Referring to FIGS. 8 and 9, one embodiment of straight-line clamp 302 has a clamp housing 308 that is fixedly attached to sharpener housing 260 or to another object. Only a right-side portion of clamp housing 308 is shown in FIG. 9. Attachment to sharpener housing 260 may be achieved, for example, by using threaded fasteners that pass through sharpener housing 260 and engage or pass through openings 310 in straight-line clamp 302. Straight-line clamp 302 may also be secured to sharpener housing 260 by tightening nut 312 against top 262*a* of sharpener housing 260. Straight-line clamp 302 includes a wedge member block 314 attached to a wedge member 320 at a first wedge member end 320*a*. Wedge member block 314 has a slot 318 to receive L-bracket 316, which is pivotably attached at a first L end 316*a* at first pivot point 315, such as by a pin extending through wedge member block 314 and L-bracket 316. Second L end 316*b* (visible in FIGS. 10A & 10B) is pivotably attached at second pivot point 322 to elbow brackets 324. A handle 326 is fixedly attached to elbow brackets 324. Elbow brackets 324 are pivotably attached to clamp housing 308 at a third pivot point 328.

In one embodiment, at least one of clamping members 130, 140 has a slot or channel 330 along its inside surface 130*a*, 140*a* sized and configured to receive or guide second wedge member end 320*b* or an attachment thereto. As noted above, slot 300 may also be used for a sliding shoulder or fulcrum block 304. For example, engagement surfaces 332 are attached to wedge member 320 and are aligned to engage inside surfaces 330*a* of channels 330 in first and second clamping members 130, 140. Channels 330 extend into inside surfaces 130*a*, 140*a* by the distance of a channel depth 330*a* that preferably tapers from a first depth 330*a* near proximal end portions 132, 140 to a second, shallower depth 330*b* towards upper portion 139, 149.

Figure 10A:
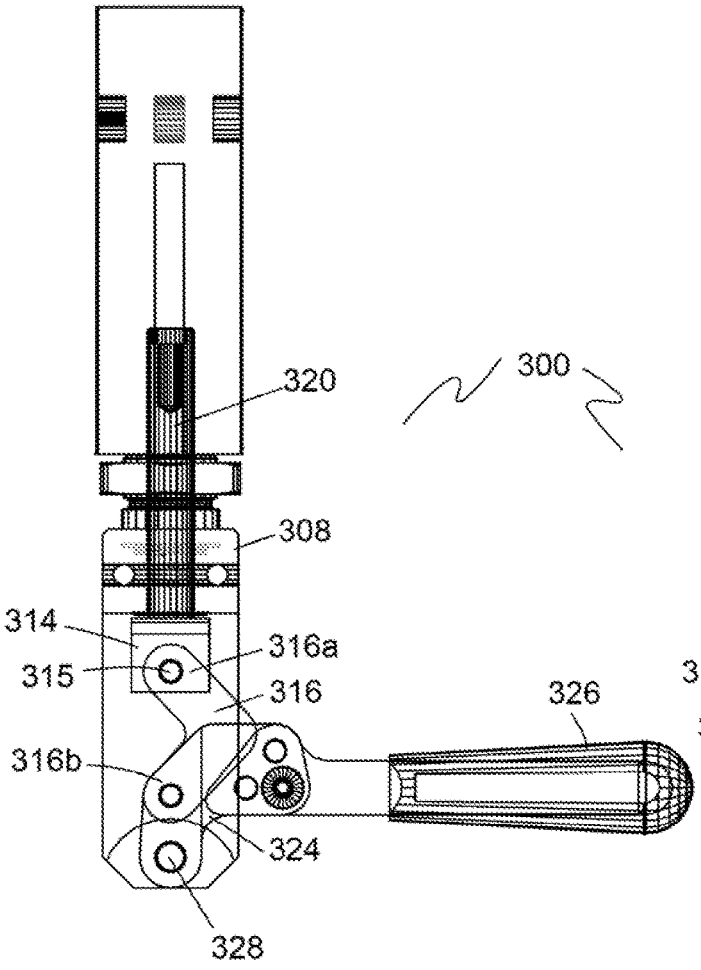
FIG. 10A is a side view showing the clamping assembly of FIG. 7 in a first position.
Figure 10B:
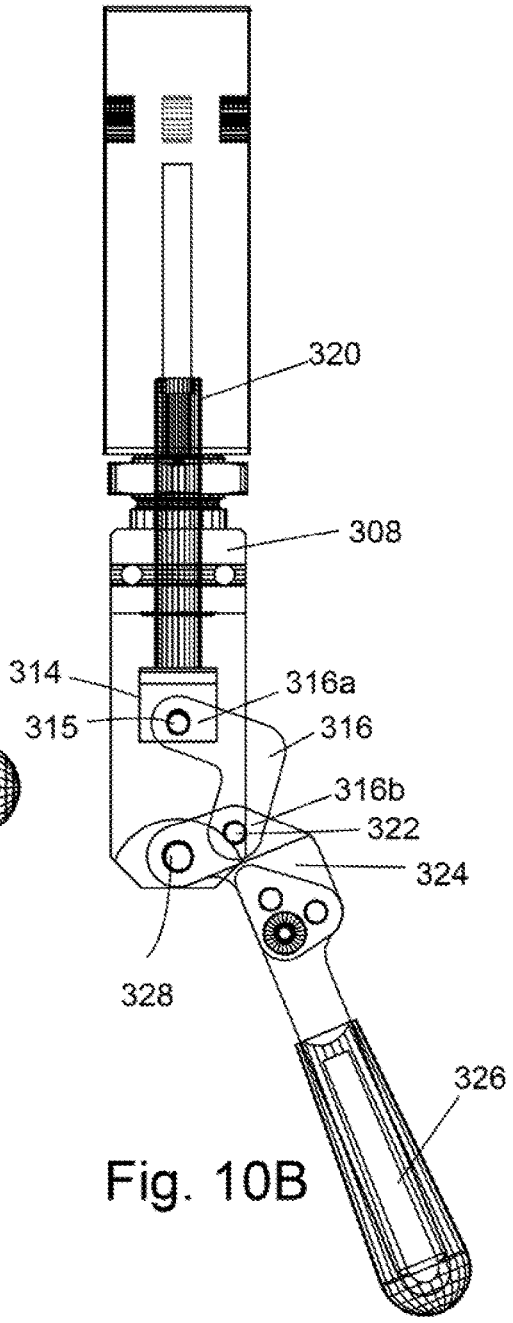
FIG. 10B is a side view showing the clamping assembly of FIG. 7 in a second position.

Referring to FIGS. 10A and 10B, side views illustrate clamping assembly 300 in a first position and a second position, respectively. As handle 326 is moved from a first position (shown in FIG. 10A) to a second position (shown in FIG. 10B), elbow brackets 324 rotate about third pivot point 328, causing second L end 316*b* of L-bracket 316 to move forward and draw wedge member block 314 and wedge member 320 vertically downward. In one embodiment, by moving handle 326 between first position and second position, second wedge member end 320*b* changes in vertical position by about 0.75 inch. While FIG. 10A shows a downward movement of handle 326 moves wedge member vertically downward, clamping assembly can be configured where an upward movement of handle 326 moves wedge member vertically downward.

Although wedge member 320 is shown in the figures as having a cylindrical shape, wedge member 320 may also be a wedge, bar, block, or other shape that is configured to increasingly separate proximal end portions 132, 142 of first and second clamping members 130, 140, respectively, as wedge member 320 advances upwardly or otherwise between them. In one embodiment, second wedge member end 320*b* has engaging surface(s) 322, such as a roller, block, shoulder, protrusion, or other geometry that is shaped and configured to slidably engage or roll along inside surfaces 130*a*, 140*a* of clamping members 130, 140, respectively. As wedge member 320 moves upward between clamping members 130, 140, proximal end portions 132, 142 of clamping members 130, 140 are forced apart. Clamping members 130, 140 pivot about fulcrum block(s) 304 causing top portions 139, 149 of clamping members 130, 140 to move towards each other. Thus, when cutting implement 8 is positioned between clamping members 130, 140, handle 326 is moved to its first position to cause top portions 139, 149 to firmly engage cutting implement 8 and securely hold it in place for sharpening.

In other embodiments of clamping assembly 300, wedge member 320 has gears or threads. Wedge member 320 may alternately be advanced upward between first and second clamping members 130, 140 by engagement between a worm drive and gear or threads on wedge member 320. In other embodiments, the end of a lever or bar may be positioned between proximal end portions 132, 142 of clamping members 130, 140 and its opposite end moved sideways to increase or decrease gap 307 between proximal end portions 132, 142 of first and second clamping members, respectively. In such an embodiment, proximal end portions 132, 142 are preferably biased towards each other with a spring, piston, gravitational force, or other means.

Figure 11:
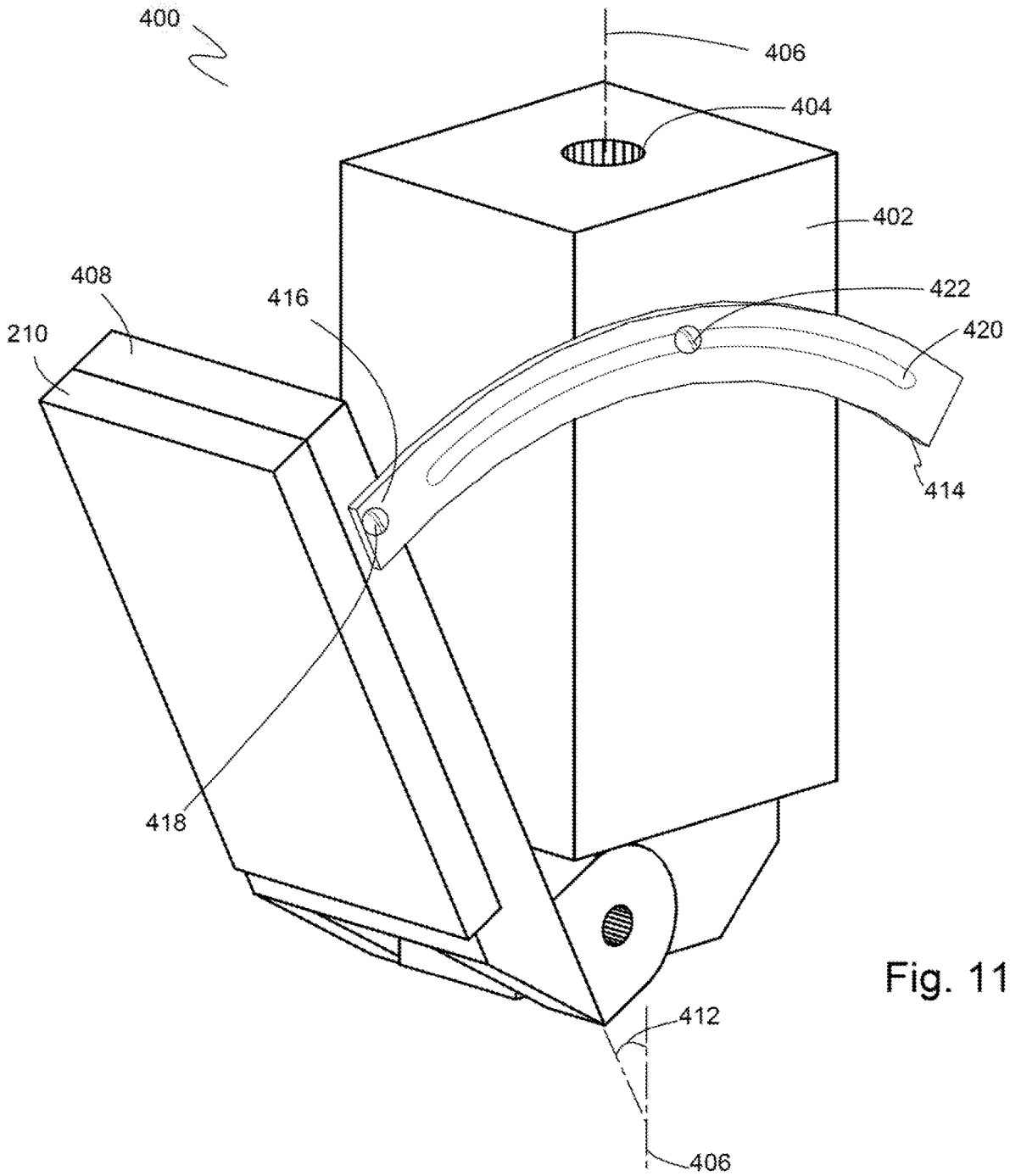
FIG. 11 is a perspective view of one embodiment of an abrasive element holder with adjustable face plate.

Referring now to FIG. 11, a perspective view illustrates another embodiment of abrasive element holder 400 with a body 402, an adjustable face plate 408, and a holder aperture 404 that extends along a guide rod axis 406. Adjustable face plate 408 is hingedly or pivotably attached to body 402 of abrasive element holder 400. Adjustable face plate defines a second stone angle 412 with guide rod axis 406. Adjustable face plate 408 is preferably a substantially planar rectangular plate that is configured to receive sharpening block 210. Sharpening block 210 is removably attached to adjustable face plate 408 similar to attachment methods described above for abrasive element holder 200.

A second stone angle 412 may be set and adjusted between adjustable face plate 408 and guide rod axis 406. Abrasive element holder 400 optionally has an angle guide 414 attached between adjustable face plate 408 and slidably attached to body 402 of abrasive element holder 400. In one embodiment, angle guide 414 is fixed at one end 416 to adjustable face plate 408 with a fastener 418. Angle guide 414 has a slot 420 and fastener 422 extending into body 402 for slidable adjustment of second stone angle 412. Fastener 422 may be tightened against angle guide 414 to "lock in" second stone angle 412. Notches (not shown) along angle guide may similarly be used to adjust and lock in second stone angle 412, where a notch is hooked over fastener 422 or other protrusion from body 402. In other embodiments, adjustable face plate 408 is adjusted by moving a threaded rod or fastener (not shown) forward or backward between body 402 and adjustable face plate 408.

Figure 12A:
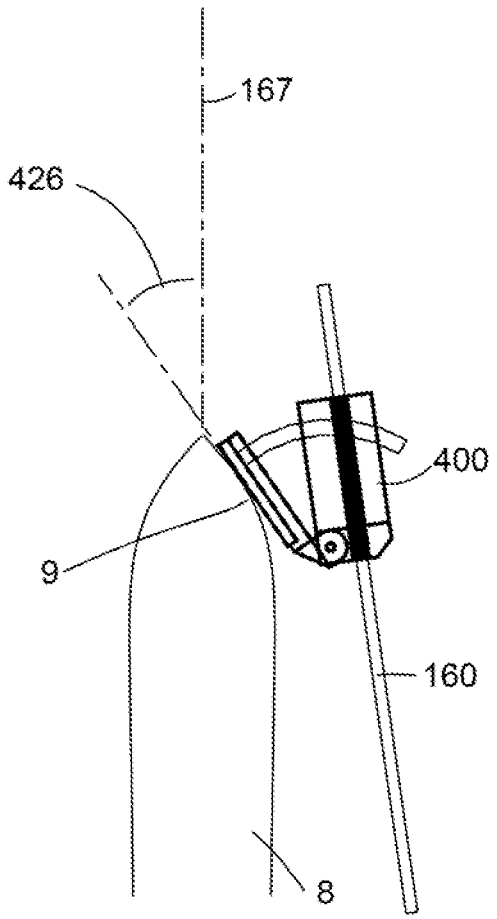
FIG. 12A is a side view of the abrasive element holder of FIG. 10 engaging the cutting surface of a cutting implement at a first position along the guide rod.
Figure 12B:
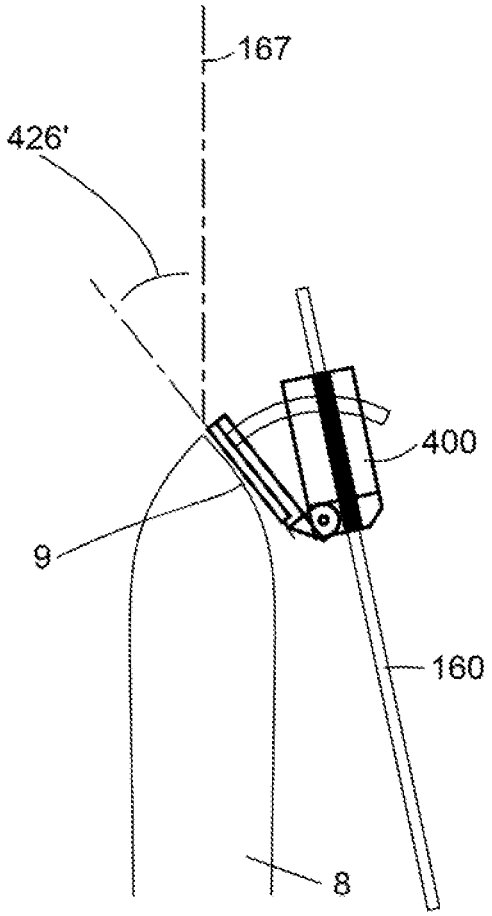
FIG. 12B is a side view of the abrasive element holder of FIG. 10 engaging the cutting surface of a cutting implement at a second position along the guide rod.

Referring now to FIGS. 12A and 12B, abrasive element holder 400 enables the user to precisely sharpen cutting implements 8 having a curved cutting edge 9 as is found on sport knives, barber's shears, and other cutting implements. As the user slides abrasive element holder 400 up and down guide rod 160, angle 426 changes between sharpening block 210 and vertical plane 167 through cutting implement 8. As shown, abrasive element holder 400 in FIG. 12A is at a lower position on guide rod 160 than in FIG. 12B. As a result, angle 426 is smaller than angle 426'. Using this approach, cutting implements 8 with curved cutting edges 9 can be precisely sharpened.

Figure 13:
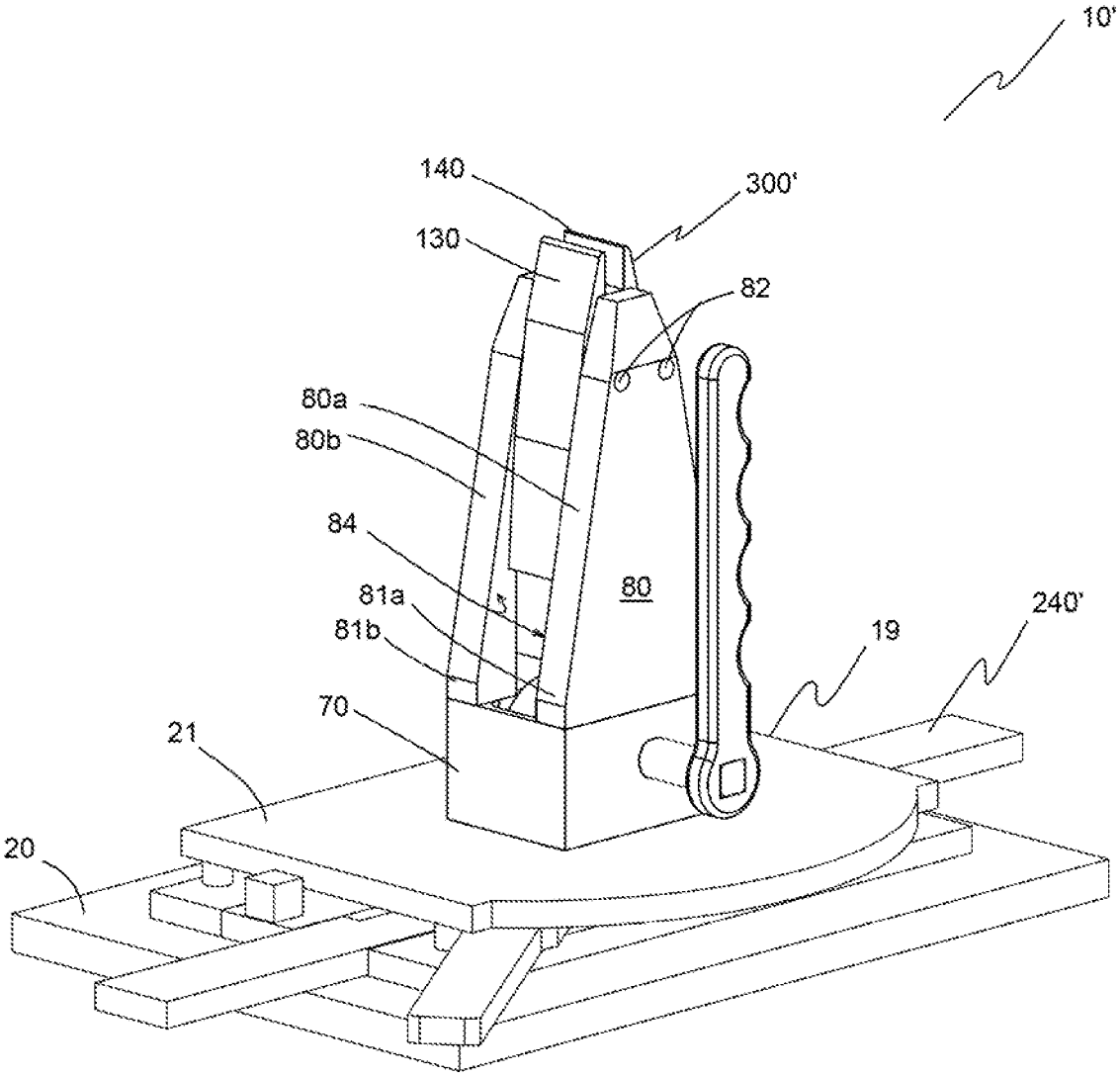
FIG. 13 is a left, perspective view of a knife sharpener of the present disclosure showing embodiments of a base assembly, a clamping assembly, and a rod positioning assembly.

Referring now to FIG. 13, a left perspective view illustrates components of another embodiment of sharpener 10' that includes a base assembly 19, clamping assembly 300', and rod positioning assembly 240'. For clarity, not all components of sharpener 10' are shown. Base assembly 19 includes base 20, upper base plate 21 attached to base 20 in a spaced-apart and substantially parallel relation, riser block 70 secured to upper base plate 21, and at least one support member 80 extending from riser block 70. Rod positioning assembly 240' is disposed between base 20 and upper base plate 21.

In one embodiment, clamping assembly 300' includes first support member 80*a* and second support member 80*b*, each of which extends upward from riser block 70 in substantially parallel and spaced-apart relation to each other. In some embodiments, support members 80*a*, 80*b* are fixedly attached to riser block 70, such as by using screws, welding, or other means. For example, fasteners extend through upper base plate 21, through riser block 70, and into a proximal end portion 81*a*, 81*b* of support members 80*a*, 80*b*, respectively. In other embodiments, riser block 70 is omitted and support members 80 extend upward from and are connected directly to upper base plate 21.

Each support member 80 has a plurality of support pins 82 or rods extending from an inside surface 84 and into first and second clamping members 130, 140. Each of first and second clamping members 130, 140 pivots about one or more support pin 82 that extends through or into the respective clamping member 130, 140.

Figure 14:
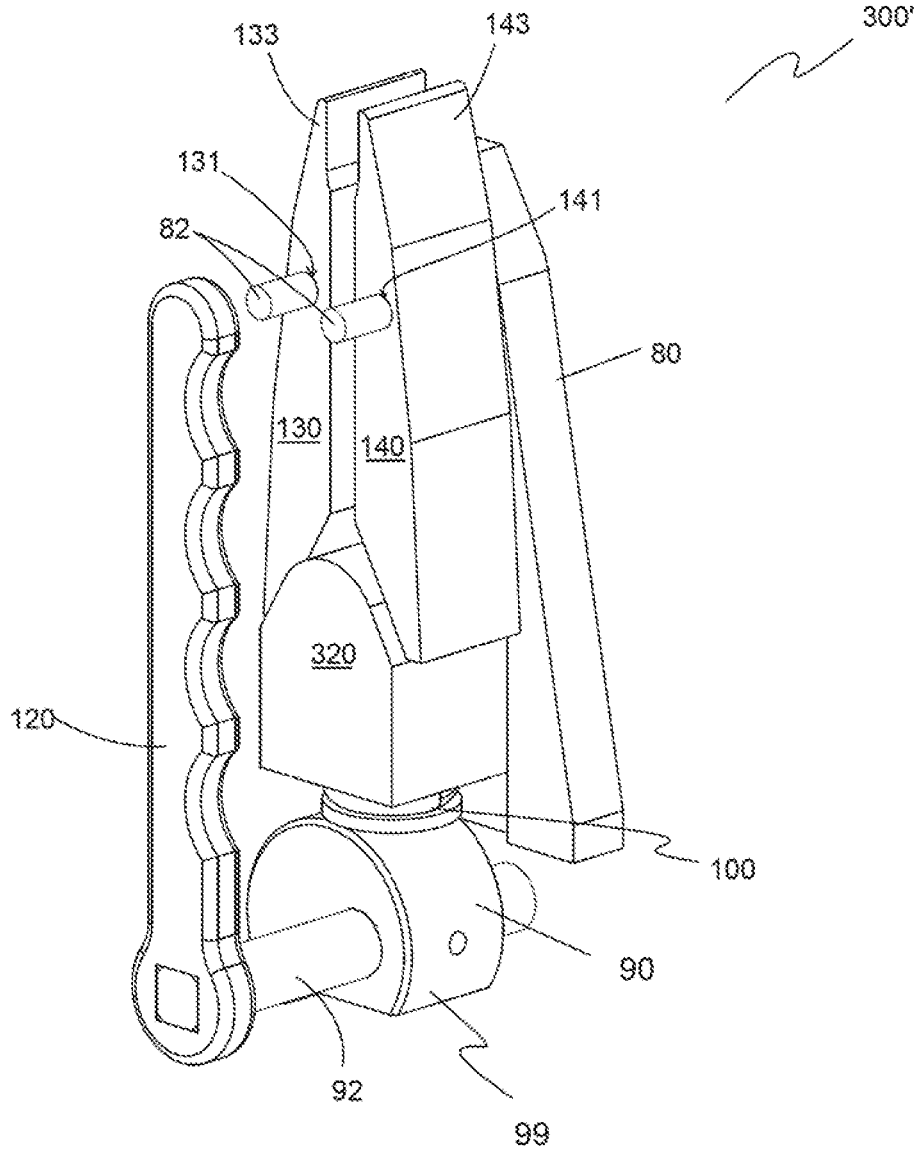
FIG. 14 is a right, perspective view of part of the clamping assembly of FIG. 13.

Referring now to FIG. 14, a right perspective view shows clamping assembly 300' with support member 80*b*. Clamping assembly 300' includes first and second clamping members 130, 140, and a cam assembly 99 that includes a cam member 90, follower assembly 100, and handle 120 connected to cam member via cam shaft 92. Each of first and second clamping members 130, 140 has a support pin opening 131, 141 sized to receive a corresponding support pin 82 extending, for example, therethrough from support member 80*b*.

Operation of handle 120 rotates cam member 90, which acts on follower assembly 100 to cause first and second clamping members 130, 140 to pivot and therefore to engage cutting implement 8 (shown in FIG. 3) disposed between distal end portions 133, 143, respectively.

Figure 15:
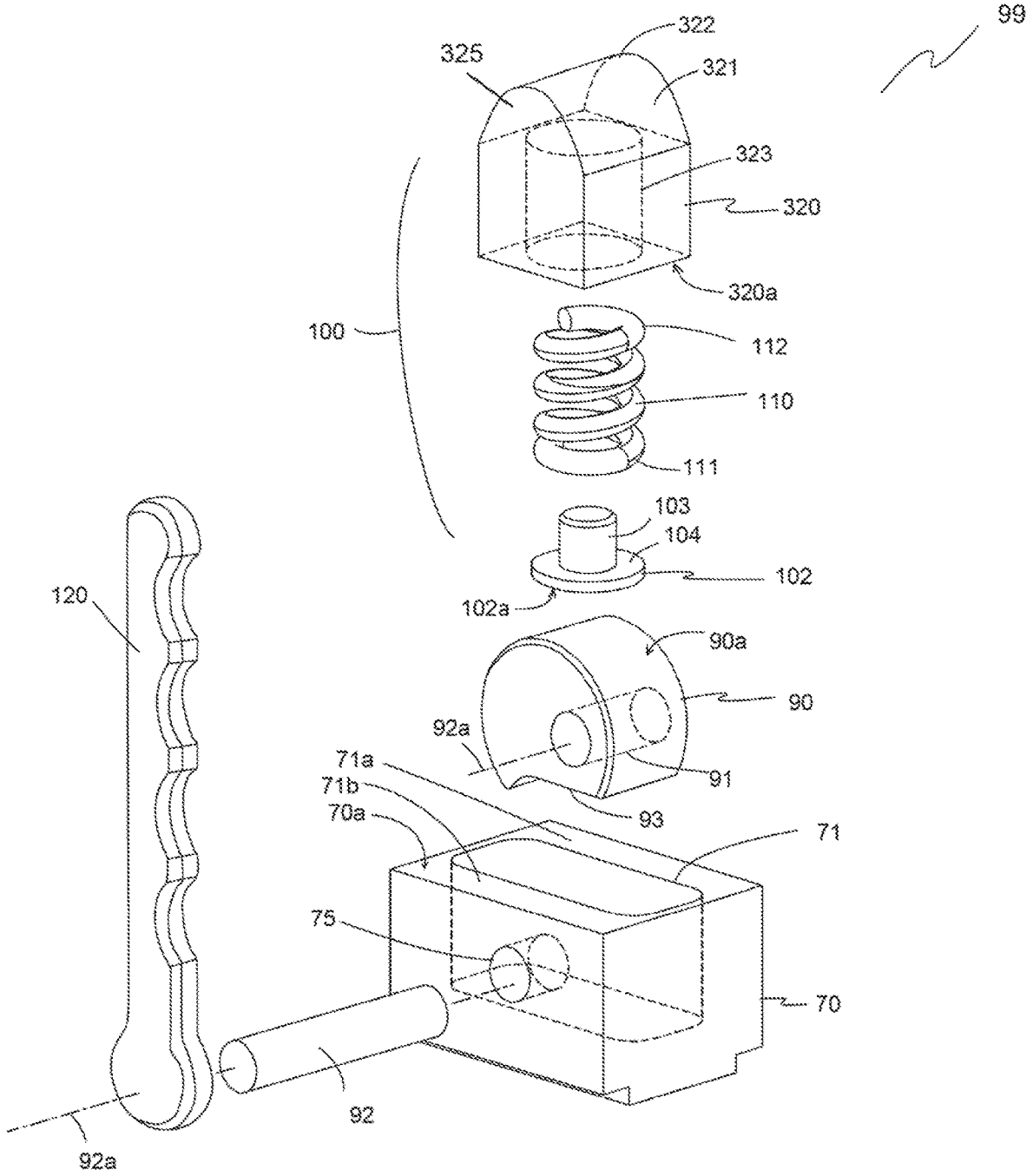
FIG. 15 is an exploded view of the clamping assembly of FIG. 14.

Referring now to FIG. 15, a perspective, exploded illustration shows components of one embodiment of cam assembly 99 that includes cam member 90, follower assembly 100, handle 120, cam shaft 92, and riser block 70. Riser block 70 defines a cam member well 71 that extends into riser block 70 through riser block top surface 70*a*. Cam member well 71 is sized to receive cam member 90 partially or completely and permit its rotation therein about cam shaft axis 92*a*. In one embodiment, cam member 90 is disposed between opposite well walls 71*a*, 71*b* of riser block 70. A cam shaft opening 75 extends through well wall 71*b* to cam member well 71. Cam shaft 92 extends through cam shaft opening 75 to cam member 90 disposed in cam member well 71.

One embodiment of cam member 90 has a cam shaft opening 91 sized to receive one end of cam shaft 92. Cam shaft 92 may be operatively connected to cam member 90 in other ways, such as being integrally connected by welding or being formed as a single item, or by using a coupler to connect cam shaft 92 to cam member 90. Cam shaft 92, or portion thereof, can have a cross-sectional shape that is circular, rectangular, triangular or other regular or irregular geometric shape. In one embodiment, for example, a tip of cam shaft 92 has a square cross-sectional shape that is received in a square cam shaft opening 91.

Cam surface 90*a* is eccentric of cam shaft axis 92*a* and may have a spiral, circular, oval, snail, or other profile shape that results in rise and fall of follower assembly 100 to operate first and second clamping members 130, 140 as cam member 90 is rotated. In one embodiment, cam member 90 has a generally circular shape with cam shaft axis 92*a* being off-center to the circular shape. A handle 120 is attached to the opposite end of cam shaft 92. Handle 120 can be a lever, wheel, knob, bar, protrusion, enlargement, or other structure that facilitates the user in rotating cam shaft 92 and therefore in rotating cam member 90.

Follower assembly 100 includes follower 102, a resilient compressible member 110, and wedge member 320. In one embodiment, follower 102 is a flanged follower pin that includes a pin portion 103 extending from a disk-shaped flange 104. Pin portion 103 usually has a cylindrical cross-sectional shape, but other cross-sectional shapes are acceptable. Follower 102 has a bottom surface 102*a* that contacts cam member surface 90*a* as cam member 90 rotates or moves. In one embodiment, bottom surface 102*a* is on flange 104. Pin portion 103 is sized to fit into resilient compressible member 110 that is a spring, where resilient compressible member 110 preferably abuts flange 104. In other embodiments, follower 102 has a cup shape that receives resilient compressible member 110 in a central cup opening (not shown).

In one embodiment, resilient compressible member 110 is a helical compression spring (i.e., coil spring), but may also be a wave spring, one or more stacked wave washers, a resilient compressible polymer, or other resilient member. For example, resilient compressible member 110 is polyurethane, such as polyurethane 95A, with an uncompressed thickness of about 35 mm between wedge member 320 and follower 102. Other materials and thicknesses are acceptable. In other embodiments, resilient compressible member 110 is a gas piston, a gas piston together with a spring, or other compressible structure that compresses under a load and returns to its uncompressed shape partially or completely after the load is reduced or removed. In one embodiment, resilient compressible member 110 is retained on follower 102 by having pin portion 103 of follower 102 inserted in a first compressible member end portion 111 (e.g., lower end), with first compressible member end portion 111 abutting flange 104. In other embodiments, first compressible member end portion 111 is attached to follower 102 with a clip, hook, fastener, welding, or other method.

In the embodiment shown in FIG. 15, wedge member 320 is a block with a generally rectangular shape and is sized to engage inside surfaces 130*a*, 140*a* along first proximal end portion 132 and second proximal end portion 142, respectively. In one embodiment, wedge member 320 has a distal wedge surface 321 (e.g., top wedge surface) that is curved or angled with a wedge apex 322 that is aligned with vertical plane 167 (shown in FIG. 3) and/or cutting implement axis 305 (shown in FIG. 8). Wedge member 320 defines a well 323 that extends into wedge member 320 through wedge bottom surface 320*a*. Well 323 is sized to receive second compressible member end portion 112 of resilient compressible member 110.

Figure 16:
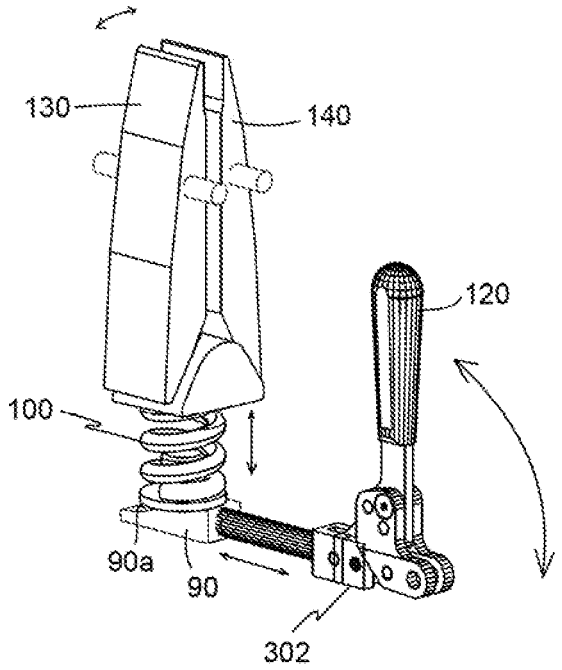
FIG. 16 is a perspective view of a clamping assembly in accordance with an embodiment of the present disclosure, showing a straight-line clamp assembly used to advance or retract a cam member along a linear path.

Referring now to FIG. 16, a perspective view shows another embodiment of cam member 90. In this embodiment, cam member 90 slides linearly in response to operation of handle 120, which is part of straight-line clamp 302. Handle 120 moves between a first position and a second position to move cam member 90 towards or away from follower assembly 100. As a result, follower assembly 100 is raised or lowered as it follows sloped cam surface 90*a*, causing clamping members 130, 140 to pivot to a clamped or an unclamped position.

Cam member 90 can be advanced or retracted with other methods. For example, cam shaft 92 threadably engages cam member 90. As cam shaft 92 rotates, cam member 90 moves along cam shaft 92 with sloped cam surface 90*a* in contact with follower assembly 100. In other embodiments, cam shaft 92 has a geared engagement with cam member 90.

Figure 17A:
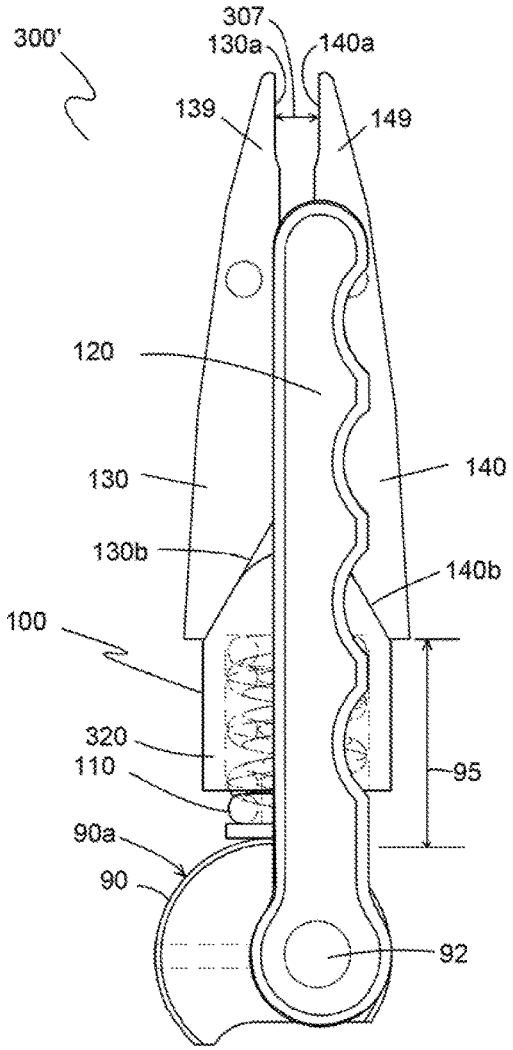
FIG. 17A is a front view showing the clamping assembly of FIG. 14 in a first or unclamped position.
Figure 17B:
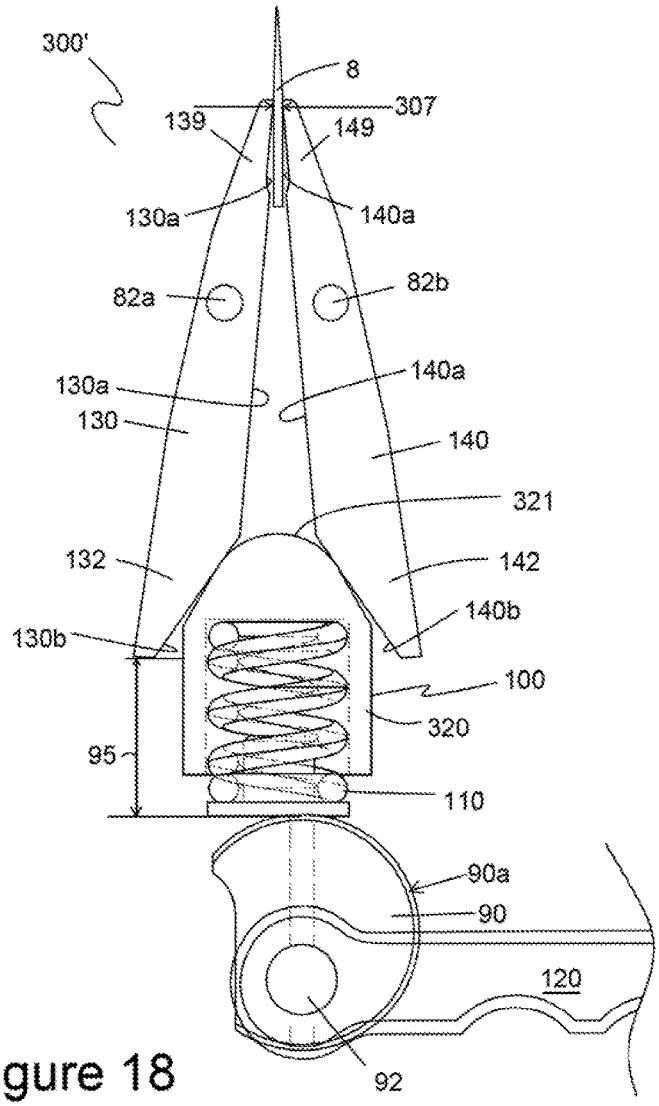
FIG. 17B is a front view showing the clamping assembly of FIG. 14 in a second or clamped position

Referring now to FIGS. 17A and 17B, front views show a portion of clamping assembly 300' in a first clamping position (e.g., open) and in a second clamping position (e.g., closed or clamped), respectively. Clamping members 130, 140 have first and second proximal end portions 132, 142 and first and second distal end portions 139, 149, respectively. Inside surfaces 130*a*, 140*a* of clamping members 130, 140, have a sloped proximal portion 130*b*, 140*b*, respectively. In the first clamping position (e.g., open) shown in FIG. 17A, handle 120, cam shaft 92, and cam member 90 are positioned so that cam surface 90*a* has an increased distance 95 to clamping members 130, 140. Wedge member 320 may contact sloped proximal portions 130*b*, 140*b* of clamping members 130, 140, respectively, but the position of wedge member 320 in the non-clamping position does not cause distal portions 139, 149 to pivot together to close gap 307 on cutting implement 8 (e.g., a knife; shown in FIG. 17B) and resilient compressible member 110 is not compressed or is minimally compressed.

As handle 120 is rotated to the second clamping position (e.g., closed or clamped) as shown in FIG. 17B, cam member 90 rotates to reduce distance 95 from cam surface 90*a* to clamping members 130, 140, thereby causing follower assembly 100 to move linearly (e.g., upward) towards clamping members 130, 140. As follower assembly 100 moves to the second clamping position, distal wedge surface 321 of wedge member 320 engages sloped proximal portions 130*b*, 140*b* of inside surfaces 130*a*, 140*a*, respectively. As it does so, clamping members 130, 140 pivot about support pins 82*a*, 82*b*, respectively, thereby forcing apart proximal portions 132, 142 and closing gap 307 with distal portions 139, 149 clamping cutting implement 8. Since knife is typically made of steel and therefore is generally incompressible, when handle 120 is further rotated after distal portions 139, 149 contact cutting implement 8, wedge member 320 cannot move further between clamping members 130, 140, so resilient compressible member 110 compresses providing a predefined compression force to clamping members 130, 140.

As cam member 90 rotates to the second clamping position, it compresses resilient compressible member 110. The compression force of resilient compressible member 110 makes it possible for the clamping assembly 300' to hold and lock onto knives 8 of varying thicknesses without having to adjust gap 307 between clamping members 130, 140. When cam member 90 is in the second clamping position, such as with handle 120 rotated ninety degrees relative to the first clamping position as shown in FIGS. 17A-17B, all or most of the spring force is exerted against cam member 90, effectively locking clamping assembly 300 in the clamping position. Resilient compressible member 110 also enables the user to continue to rotate handle 120 after clamping members 130, 140 have engaged cutting implement 8. Since top portions 139, 149 of clamping members 130, 140, respectively, are generally not able to close further after engaging cutting implement 8, resilient compressible member 110 compresses as handle 120 continues to rotate and move cam follower 102 vertically towards clamping members 130, 140.

In some embodiments, it may be desirable to adjust the gap 307 between clamping members 130, 140 to engage cutting implements 8 of different thickness. Similarly, it may be desirable to increase or decrease the clamping force on cutting implement 8 when clamping assembly 300' is in the second clamping position (e.g., closed or clamped). Since gap 307 and the clamping force are related, a change in one can affect the other. In embodiments, the clamping force is adjusted by changing the amount of compression of resilient compressible member 110 when handle 120 is in the second clamping position. In embodiments, the gap 307 between clamping members 130, 140 is adjusted by changing the vertical distance between cam member 90 and clamping members 130, 140, such as by changing the vertical size of follower assembly 100 or vertical position of various components. In one embodiment, for example, wedge member 320 includes a set screw that moves a bias plate to adjust the depth of well 323 in wedge member 320. As such, compression of resilient compressible member 110 can be adjusted by changing the vertical size of follower assembly 100. In another example, one or both of sloped surfaces 130*b*, 140*b* includes an adjustable bias plate (not shown) that advances or retreats from the respective inside surface 130*a*, 140*a* to independently adjust the point of contact between wedge member 320 and each of clamping members 130, 140. Such an adjustment can also be used to align cutting implement 8 with vertical plane 167 when clamping assembly 300' is in the second clamping position.

Figure 18:
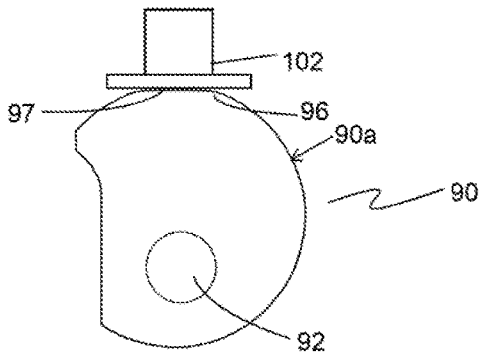
FIG. 18 is a front view of a cam in accordance with an embodiment of the present disclosure showing the cam in contact with a follower.

Referring now to FIG. 18, a front view of another embodiment of cam member 90 is shown, where cam surface 90*a* optionally has a straight or flat portion 97. Flat portion 97 further facilitates locking clamping assembly 300 in the second clamping position (e.g., closed or clamped). As cam member 90 rotates, follower 102 passes over cam shoulder 96, which provides an increased amount of compression compared to that of flat portion 97 since it extends further from cam shaft 92 than does flat portion 97. Thus, resilient compressible member 110 relaxes slightly as follower 102 moves from cam shoulder 96 to flat portion 97. Similarly, resilient compressible member 110 compresses slightly when follower 102 moves from flat portion 97 to cam shoulder 96. This increase in compression "locks" clamping assembly 300' in the second clamping position since the force required to further compress resilient compressible member 110 is greater than the force required for clamping assembly 300' to slip out of the second clamping position. For the same reason, flat portion 91 provides a stopping point that is perceivable to the user for rotating handle 120 to the second clamping position.

Figure 19:
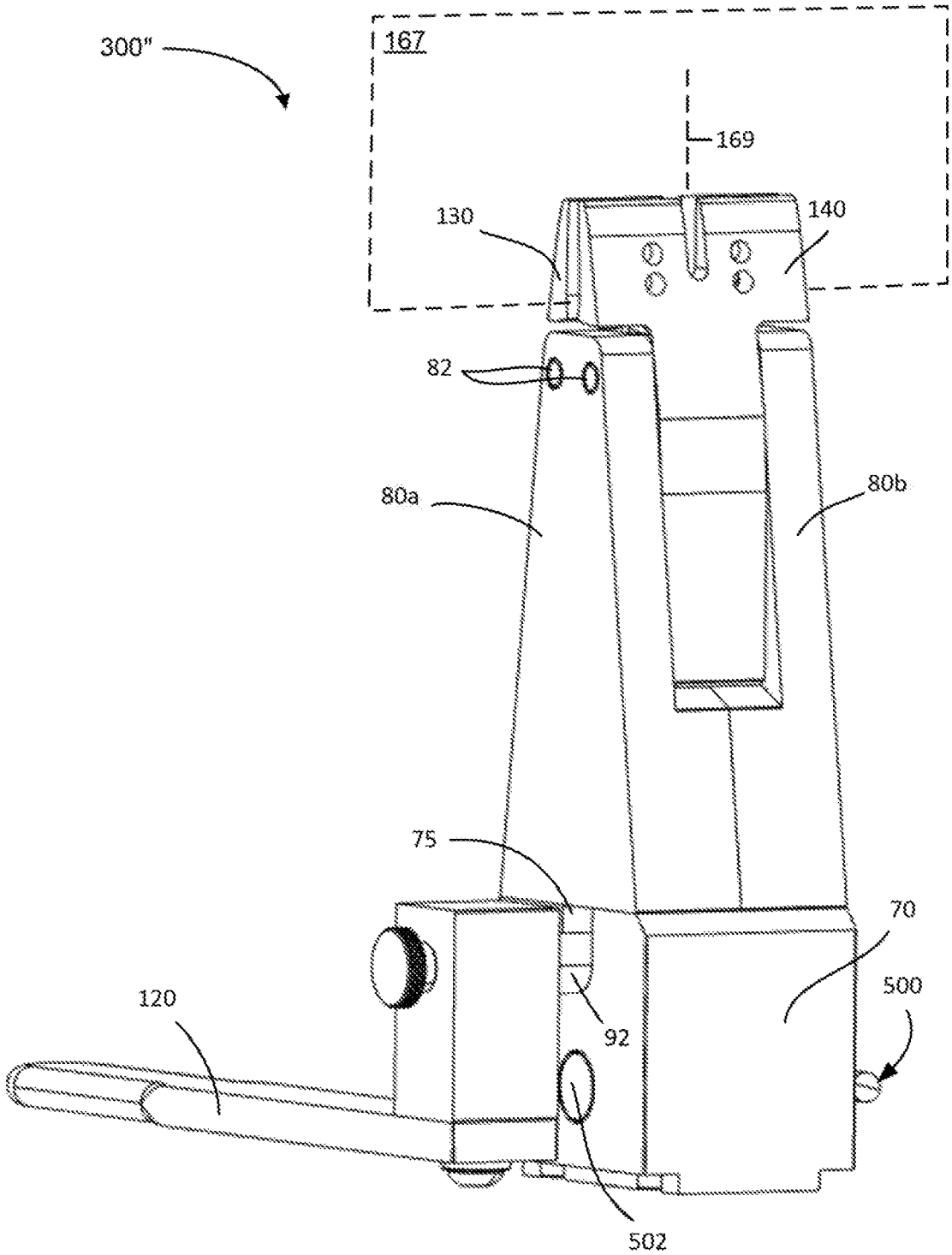
FIG. 19 is a front and right-side perspective view illustrating a clamping assembly in accordance with an embodiment of the present disclosure.
Figure 20:
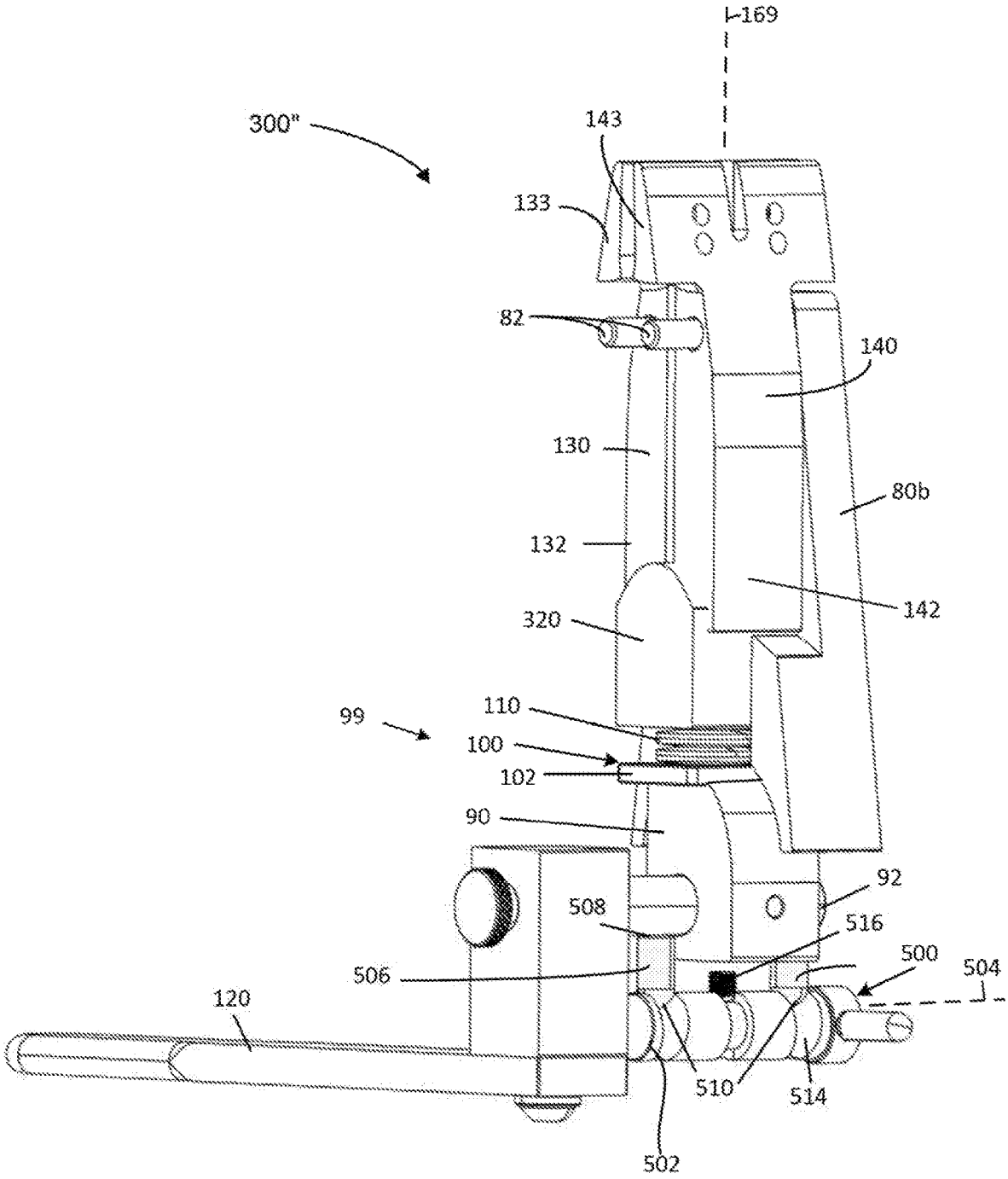
FIG. 20 is a front and right-side perspective view of the clamping assembly of FIG. 19 with portions of the assembly omitted to show details of a clamp adjustment assembly in accordance with an embodiment of the present disclosure.
Figure 21:
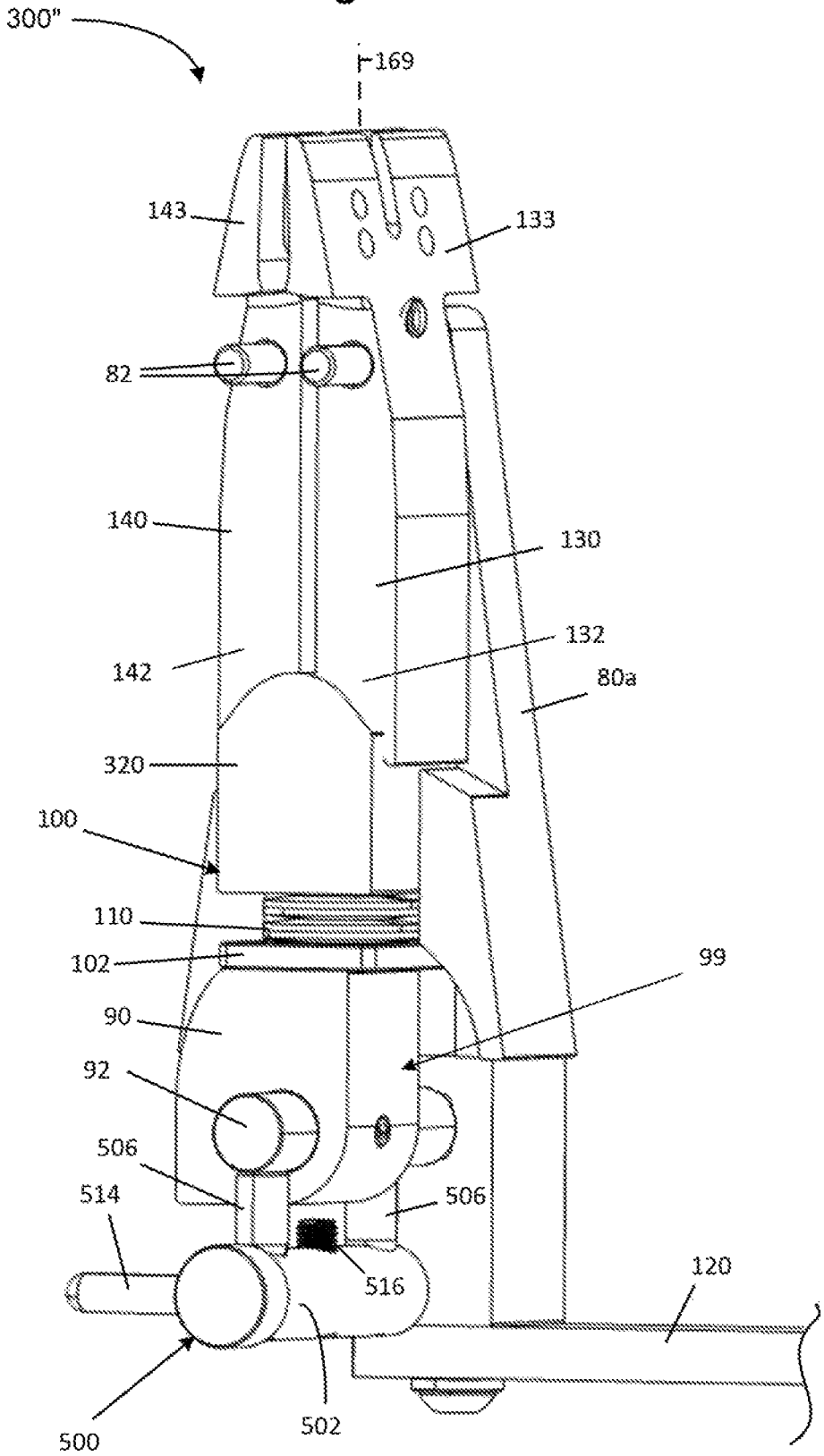
FIG. 21 is a rear and left-side perspective view of the clamping assembly of FIG. 19 with portions of the assembly omitted for clarity.
Figure 22:
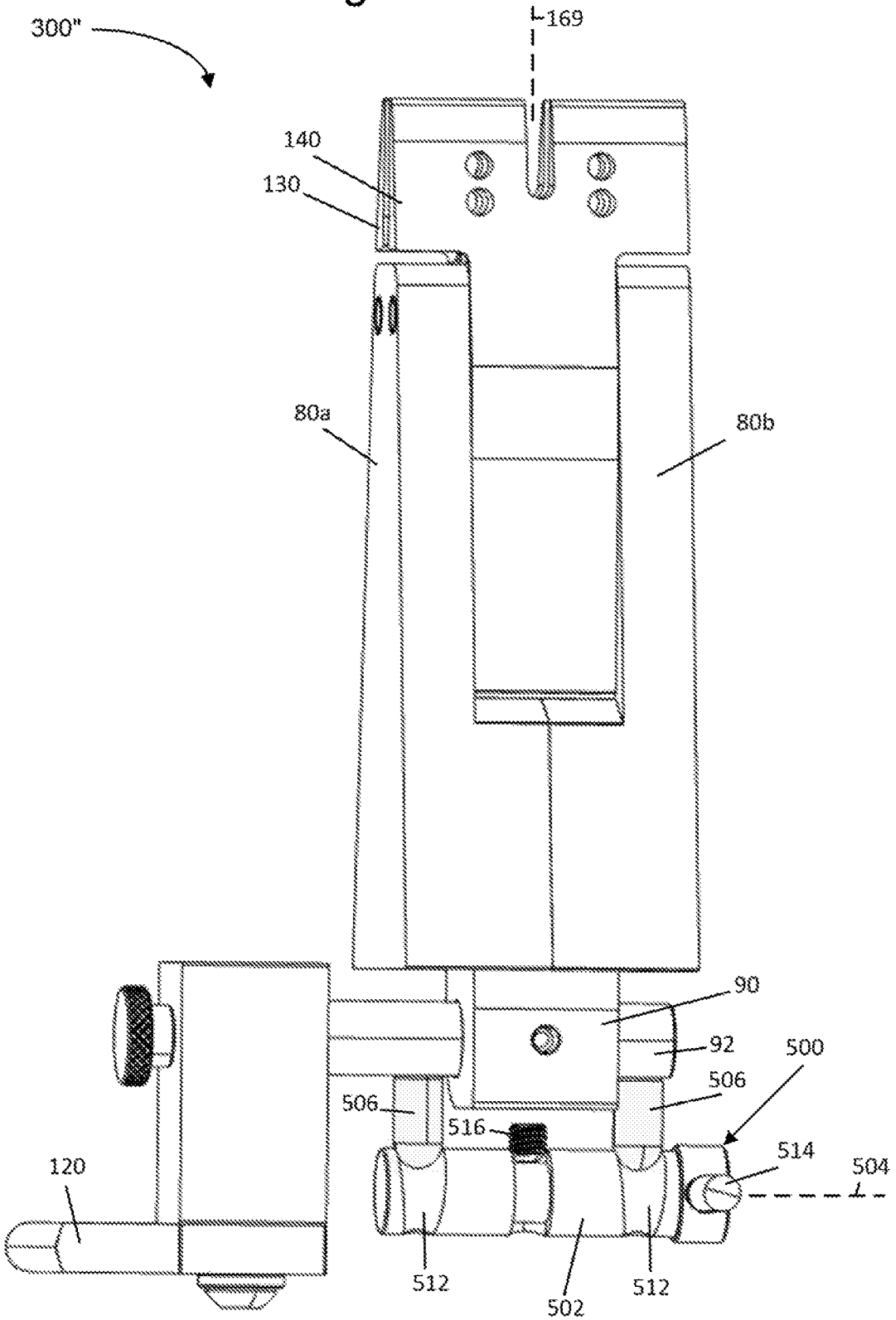
FIG. 22 is a right-side view of the clamping assembly of FIG. 19 with portions of the assembly omitted for clarity.

FIGS. 19-22 illustrate another embodiment of clamping assembly 300" that includes a clamp adjustment assembly 500 for adjusting the clamping force on cutting implement 8 (shown, e.g., in FIG. 17B) and/or changing gap 167 between clamping members 130, 140. FIG. 19 illustrates a front and right-side perspective view of clamping assembly 300"; FIG. 20 illustrates a front and right-side perspective view of clamping assembly 300" with riser block 70 and front support member 80*a* omitted for clarity; FIG. 21 illustrates a rear and left-side perspective view of clamping assembly 300" with riser block 70 and rear support member 80*b* omitted for clarity; and FIG. 22 illustrates a right-side view of clamping assembly 300" with riser block 70 omitted to show detail of clamp adjustment assembly 500.

As with other embodiments discussed above, clamping assembly 300" includes first clamping member 130, second clamping member 140, riser block 70, front support member 80*a*, rear support member 80*b*, and cam assembly 99 with cam member 90, cam shaft 92, and follower assembly 100. First clamping member 130 and second clamping member 140 extend in opposed alignment along a central clamp axis 169 (e.g., a vertical axis) with inside surface 130*a* of first clamping member 130 and second inside surface 140*a* of second clamping member 140 facing each other from opposite sides of vertical plane 167. Handle 120 is operable between the first clamping position (e.g., open or unclamped) and the second clamping position (e.g., closed or clamped). As wedge member 320 moves along clamp axis 169 between first proximal end portion 132 and second proximal end portion 142 (i.e., in a direction generally perpendicular to the clamping force), clamping members 130, 140 pivot to engage cutting implement 8 between first distal end portion 133 and second distal end portion 143, and resilient compressible member 110 begins to compress. When cam member 90 continues to rotate toward the second clamping position, follower 102 continues to advance along central clamp axis 169 towards first distal end portion 133 and second distal end portion 143 and causes resilient compressible member 110 to further compress.

Cam member 90 is retained in cam member well 71 (shown e.g., in FIG. 15) between clamp adjustment assembly 500 and follower assembly 100. Cam shaft opening 75 is configured as a slot to enable cam shaft 92 to translate along central clamp axis 169 (e.g., vertically) as required due to a change in position of cam assembly 99 by clamp adjustment assembly 500.

To adjust the amount of compression to resilient compressible member 110 when handle 120 is in the second clamping position, and therefore adjust the clamping force, clamping assembly 300" includes clamp adjustment assembly 500. As appreciated by those of skill in the art, a spring has a spring force that is proportional to the amount of compression or expansion of the spring. Thus, when resilient compressible member 110 is a spring or other structure with a similar distance-force relationship, the force exerted by follower assembly 100 to pivot clamping members 130, 140 to the second clamping position (e.g., closed) increases with further compression of resilient compressible member 110. As such, changing the position of cam assembly 99 along central clamp axis 169, and therefore the compression of resilient compressible member 110 between cam member 90 and clamping members 130, 140, is a way to increase or decrease the clamping force on cutting implement 8, where the clamping force is exerted in a direction generally perpendicular to the central clamp axis 169.

Clamp adjustment assembly 500 is configured to selectively adjust a vertical distance between cam member 90 and clamping members 130, 140. Stated differently, clamp adjustment assembly 500 is configured to selectively adjust the position of cam assembly 99 along clamp central axis 169. In doing so, clamp adjustment assembly 500 adjusts the gap 307 between clamping members 130, 140 when clamping assembly 300" is in the first clamping position, and therefore adjusts the amount of force exerted by resilient compressible member 110 (e.g., a spring) when clamping assembly 300" engages cutting implement 8 in the second clamping position. Thus, the clamping force on cutting implement 8 can be selectively adjusted as desired.

In accordance with an embodiment of the present disclosure, clamp adjustment assembly 500 includes an adjustment body 502 operably coupled to riser block 70. For example, adjustment body 502 has a generally cylindrical shape and extends into or through riser block 70 along an adjustment body axis 504 generally parallel to and positioned vertically below cam shaft 92. Adjustment body 502 is rotatable about adjustment body axis 504, where a change in a radial size of part of adjustment body 502 causes a change in vertical movement of cam member 90.

In one embodiment, clamp adjustment assembly 500 includes pins 506 extending vertically between adjustment body 502 and cam shaft 92. For example, pins 506 extend from adjustment body 502 through part of riser block 70 to engage cam shaft 92. Pins 506 function like a follower engaging adjustment body 502 structured as a cam. A first pin end 508 engages cam shaft 92 of cam member 90 and a second pin end 510 engages adjustment body 502. For example, each second pin end 510 is received in a slot or groove 512 of varying depth and extending circumferentially about adjustment body 502. As adjustment body 502 rotates, pins 506 are raised or lowered according to the depth of groove 512. First pin end 508 and second pin end 510 can have any suitable configuration, such as a flat end, a rounded end, a point, or a roller.

Adjustment body 502 is movable between a first adjustment position, such as shown in FIG. 22, and a second adjustment position (e.g., adjustment body 502 rotated up to 180° from the position shown in FIG. 22). In the first adjustment position, pins 506 extend into groove 512 at a location of greater radial depth (i.e., smaller radial thickness) than when adjustment assembly 500 is in the second adjustment position. The user may rotate adjustment body 502 using any acceptable method. For example, the user may use a handle 514 attached to adjustment body 502; a screwdriver, wrench, or other tool to engage a recess or feature in an end of adjustment body 502; a thumbwheel that engages adjustment body 502 frictionally or with gears to rotate adjustment body 502; a motor; or some other structure. An optional set screw 516 can be used to increase or decrease resistance for rotating adjustment body 502. In one embodiment, set screw 516 extends through riser block 70 from cam member well 71 or other location to engage adjustment body 502.

In other embodiments, the outside surface of adjustment body 502 defines a ridge of varying radial height from adjustment body axis 504, where pins 506 extend between cam shaft 92 and the circumferential ridge on adjustment body 502.

In another embodiment of clamp adjustment assembly 500, adjustment body 502 is a cam shaft with disc cams or the like to engage cam shaft 92 to raise or lower cam member 90. In yet another embodiment, one or more screws extend upwardly through riser block 70 to engage and vertically displace cam shaft 92 or cam member 90 along clamp central axis 169. Such an embodiment can be used, for example, when riser block 70 has an exposed bottom surface for access to the fastener(s). Numerous configurations and variations will be apparent in light of this disclosure.

Figure 23:
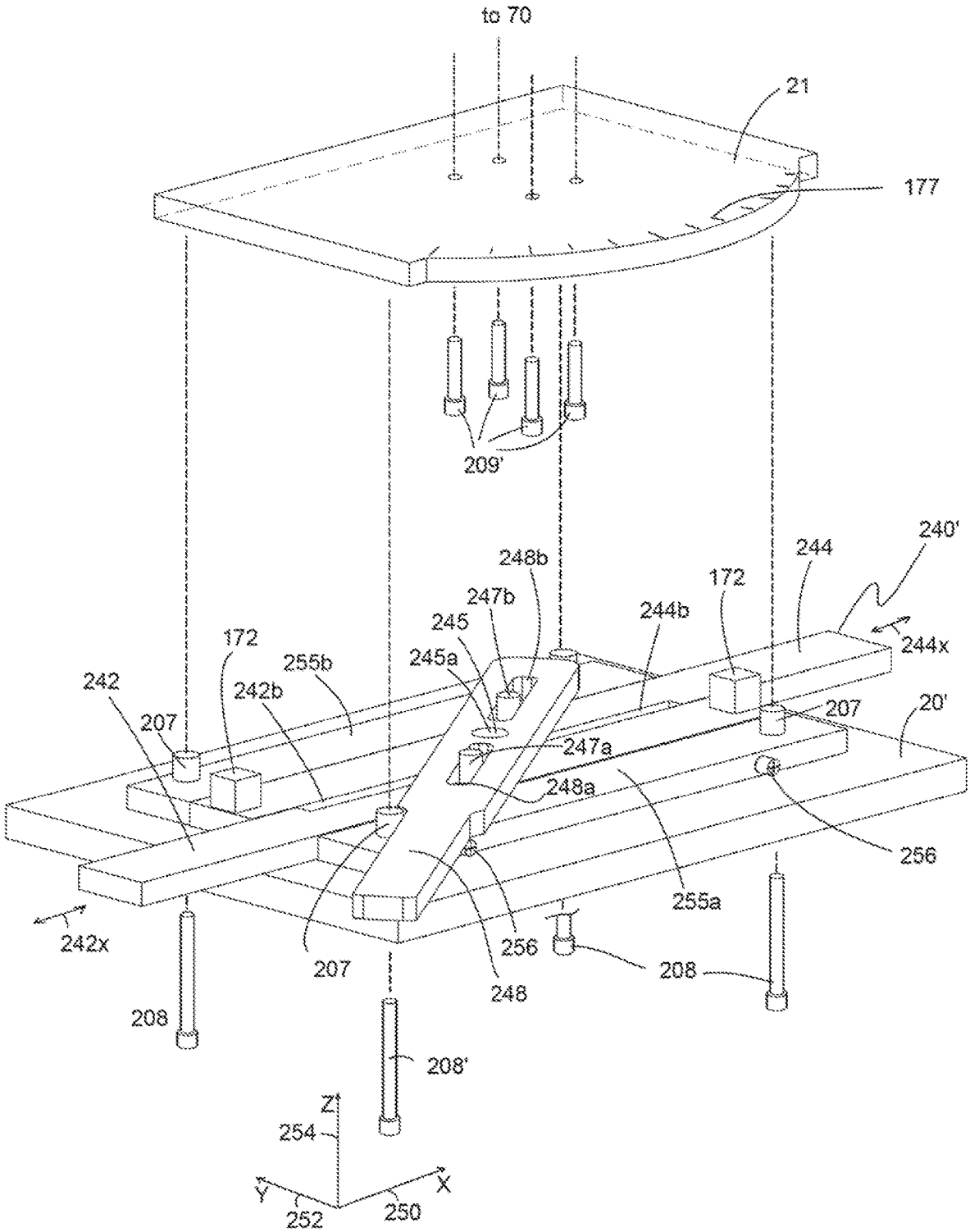
FIG. 23 is a partially exploded, perspective view of the base assembly and rod positioning assembly of FIG. 13.

Referring now to FIG. 23, a partially-exploded, perspective view illustrates parts of base assembly 19 with another embodiment of rod positioning assembly 240'. In this embodiment, rod positioning assembly 240' includes rod positioning lever 248 operatively coupled to first arm 242 and second arm 244. In one embodiment, first arm 242 and second arm 244 are elongated bars with a rectangular cross-sectional shape, although other cross-sectional shapes are acceptable. Each of first arm 242 and second arm 244 are slidably retained by base 20' with the ability to slide along a first arm longitudinal axis 242*x* parallel to a first (X) axis 250 between a first arm position and a second arm position, where first (X) axis is parallel to the first arm longitudinal axis 242*x* and the second arm longitudinal axis 244*x*. In one embodiment, arms 242, 244 are positioned between a first slide guide 255*a* and a second slide guide 255*b* that are spaced apart and substantially parallel to each other. Slide guides 255*a*, 255*b* extend substantially parallel to first (X) axis 250 and define or partially define a sliding path of each of arms 242, 244 substantially parallel to first (X) axis 250. Slide guides 255*a*, 255*b* may be a slot, channel, protrusion, rail, lip, attached bar, plurality of pins, or other structure on or attached to base 20' that is capable of maintaining the position of arms 242, 244 along a second (Y) axis 252 as arms 242, 244 move orthogonally to second (Y) axis 252.

Rod positioning lever 248 pivots about a central pivot pin 245. In one embodiment, central pivot pin 245 extends along or parallel to third (Z) axis 254 (e.g., upward) from base 20' and into or through rod positioning lever 248. A center 245*a* of central pivot pin 245 is positioned between arms 242, 244. In such an embodiment, first arm 242 has a first arm cutout 242*b* and/or second arm 244 has a second arm cutout 244*b* to accommodate central pivot pin 245 as arms 242, 244 slide in close proximity or in abutment with each other. In other embodiments, arms 242, 244 are positioned longitudinally in the direction of second axis 252 to permit arms 242, 244 to slide in opposite X-axis directions without the need for first arm cutout 242*b* and/or second arm cutout 244*b*. In yet other embodiments, central pivot pin 245 extends along or parallel to third (Z) axis 254 (e.g., downward) from a second or upper base plate 21 and into or through rod positioning lever 248. Accordingly, central pivot pin 245 may not extend between arms 242, 244, thereby obviating the need for first arm cutout 242*b* or second arm cutout 244*b*.

First arm 242 has a first guide pin 247*a* and second arm has a second guide pin 247*b* extending upward therefrom. Rod positioning lever has a first lever slot 248*a* or channel and a second lever slot 248*b* or channel positioned longitudinally along rod positioning lever 248 and each generally oriented to extend opposite of central pivot pin 245 from each other. As rod positioning lever 248 is pivoted about central pivot pin 245, first and second lever slots 248*a*, 248*b* engage guide pins 247*a*, 247*b*, respectively, causing arms 242, 244 to move in the second (X) axis 250 direction. As each arm 242, 244 moves in the second (X) axis 250 direction, a proximal end 162 of guide rod 160 (shown in FIG. 1) attached thereto by way of bracket 172 is positioned closer or farther away from vertical plane 167 (shown in FIG. 1). Therefore, rod positioning assembly 240' defines a range of contact angles 166 between abrasive element holder 200 and cutting implement 8 (shown in FIG. 2).

In one embodiment, upper base plate 21 is substantially parallel to and spaced apart from base 20'. For example, fasteners 208' extend up through base 20', through first and second slide guides 255*a*, 255*b*, through standoffs 207, and into upper base plate 21. Standoffs 207 also may function as a stop block for rod positioning lever 248. Riser block 70 (shown in FIG. 14) attaches, for example, to upper base plate 21 using fasteners 209' that extend through upper base plate 21 into rise block 70.

Optionally, upper base plate 21 has a plurality of angle measurement indicia 177, such as numbers, lines, dots, or other markings that relate the position of rod positioning lever 248 to contact angle 166 between vertical plane 167 and abrasive element holder(s) 200 (shown in FIG. 1).

Optionally, rod positioning assembly 240' includes one or more locking screws 256 that extend in the second (Y) axis 252 direction through or along first and/or second slide guides 255*a*, 255*b* to first and second arms 242, 244, respectively. For example, after setting contact angle 166 locking screws 256 can be advanced to engage first slide guide 255*a* and lock its position.

Figure 24A:
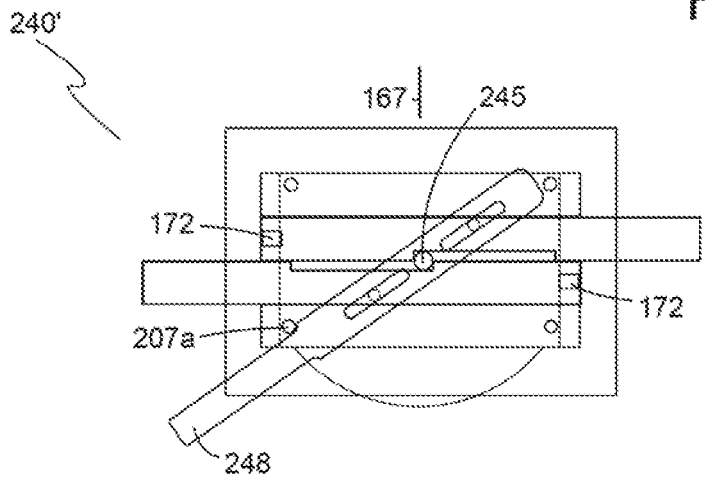
FIG. 24A is a top view of the rod positioning assembly of FIG. 18 shown with the rod positioning lever moved fully to a first position.
Figure 24B:
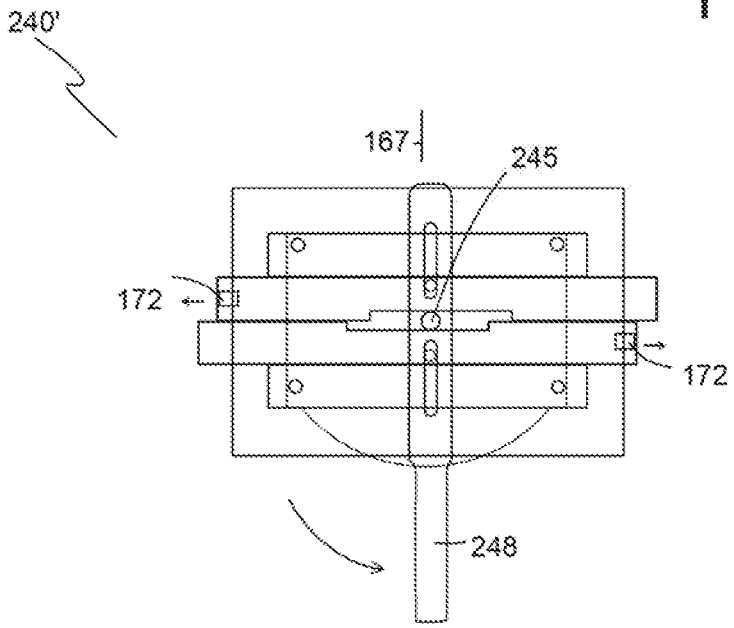
FIG. 24B is a top of the rod positioning assembly of FIG. 18 shown with the rod positioning lever in an intermediate position.
Figure 24C:
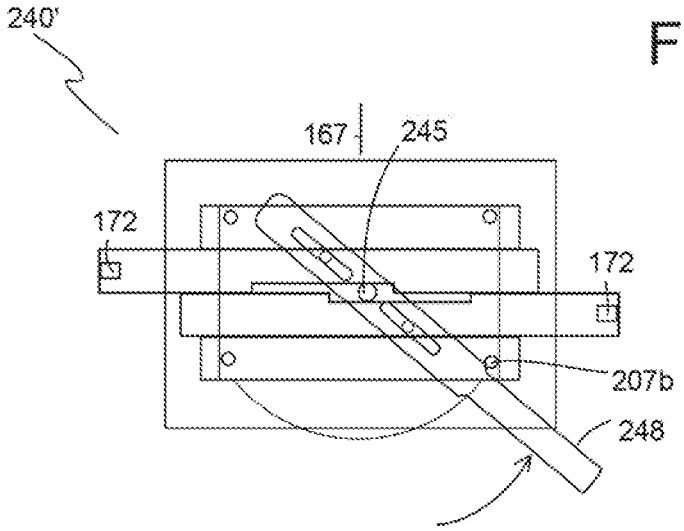
FIG. 24C is a top view of the rod positioning assembly of FIG. 18 showing the rod positioning lever moved fully to a second position.

Referring now to FIGS. 24A-24C, top plan views show rod positioning assembly 240' in a first position (FIG. 24A), in an intermediate position (FIG. 24B), and in a second position (FIG. 24C). In each view, central pivot pin 245 is aligned with vertical plane 167 (also shown in FIG. 1). In the first position shown in FIG. 24A, rod positioning lever 248 is pivoted fully left to abut standoff 207*a*, where brackets 172 on arms 242, 244 are in their closest position to vertical plane 167. In the intermediate position shown in FIG. 24B, rod positioning lever 248 is pivoted to the right, where brackets 172 are moved partially away from vertical plane 167. In the second position shown in FIG. 24C, rod positioning lever 248 is pivoted fully to the right to abut standoff 207*b* with brackets 172 moved to a farthest position away from vertical plane 167.

Figure 25:
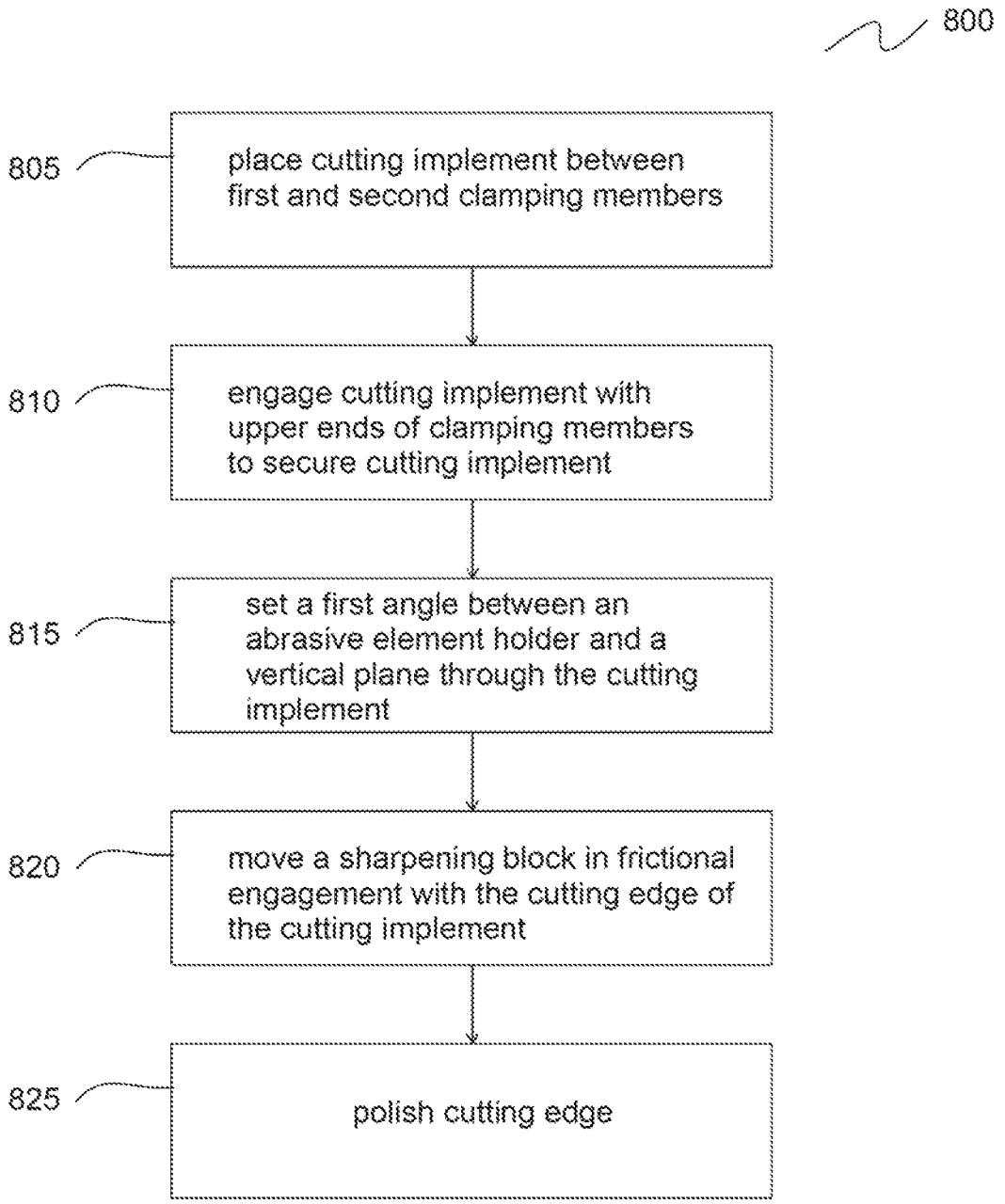
FIG. 25 is a flow chart illustrating steps in one embodiment of a method of sharpening a cutting implement in accordance with an embodiment of the present disclosure.

Referring now to FIG. 25, a flow chart illustrates steps of one embodiment of a method 800 of sharpening a cutting implement 8. In step 801, the user provides a sharpener having first and second clamping members 130, 140, a clamping assembly 300', and one or more guide rods 160 supported on a base assembly.

In step 805, a cutting implement 8 is placed between distal end portions 133, 143 of first and second clamping members 130, 140, respectively. In one embodiment, distal end portions 133, 143 are upward end portions of clamping members 130, 140 that extend upwardly.

In step 810, the distal end portions 133, 143 of the first and second clamping members 130, 140, respectively, are drawn together to engage cutting implement 8. In one embodiment, the distal end portions 133, 143 are drawn together by advancing a piston or wedge member 320 upwardly between the first and second clamping members 130, 140, thereby increasing gap 307 between proximal end portion 132 of first clamping member 130 and proximal end portion 142 of second clamping member 140 and causing distal end portions 133, 143 of the first and second clamping members 130, 140 to engage cutting implement 8. For example, sharpener 10 is selected to include cam member 90, follower assembly 100, and handle 120, where operation of handle 120 moves wedge member 320 between first and second clamping member 130, 140.

In step 815, if a contact angle or first angle 166 has not been set between an abrasive implement holder 200 and a vertical plane 167 through cutting implement 8, the user optionally adjusts first angle 166. First angle 166 can be set by changing the horizontal distance between proximal end 162 of guide rod 160 and vertical plane 167 through cutting implement 8. In one embodiment, first angle 166 is adjusted by operating rod positioning lever 248 to move first arm 242 and second arm 244 towards or away from vertical plane 167. For example, sharpener 10 is selected to include rod positioning assembly 240 with rod positioning lever 248 connected to control gear 246 or rod positioning assembly 240' with rod positioning lever 248 pivotable about a central pivot pin. When sharpening cutting implement 8 having a curved or complex cutting edge 9, the user optionally sets a second stone angle 412 between sharpening block 210 and guide rod axis 406. Setting a second stone angle 412 may be performed by using an abrasive element holder with adjustable face plate 408 and pivoting adjustable face plate 408 with respect to body 402 and guide rod axis 406.

First angle 166 is chosen in part by the cutting edge sought and in part on the type of cutting implement to be sharpened. For example, for Japanese culinary knives, first angle is typically from about nine to about thirteen degrees and may be as small as about five or six degrees. For some knives (e.g., German culinary knives), first angle 166 may be selected to be from about fifteen to about twenty-two degrees or from fifteen to about twenty-five degrees. For sport knives (e.g., bush knives), first angle may be set from twenty-five to about thirty-five degrees. For other cutting implements, such as salon shears, first angle may be selected to be from forty to sixty degrees or from forty to seventy degrees. These values are merely illustrative and acceptable values for first angle 166 are chosen as needed. These ranges for first angle 166 are not limited to any particular cutting implement and include all angles within the ranges.

Similarly, second stone angle 412 is chosen in part on the type of cutting edge sought and in part on the type of cutting implement to be sharpened. In general, a larger value for second stone angle 412 results in a greater curvature of cutting edge 9. In some cases, a larger value for second stone angle 412 reduces the need for a larger value of first angle 166. Also, a larger value for second stone angle 412 tends to provide less precision for cutting edge 9. When sharpening knives, second stone angle 412 is selected, for example, from zero to forty-five degrees. When sharpening salon shears, second stone angle 412 is selected, for example, from forty-five to eighty degrees. These values for second stone angle 412 are merely illustrative and other values for second stone angle 412 are acceptable. These ranges for second stone angle 412 are not limited to a particular type of cutting implement In step 820, sharpening block 210 attached to the abrasive implement holder 200 is drawn in frictional engagement across the cutting edge 9 of cutting implement 8 by reciprocally moving sharpening block 210 along a guide rod 160. When cutting edge 9 faces upward, this reciprocal movement is performed in an up-and-down motion. Sharpening block 210 is repeatedly drawn against and along all or a substantial portion of the length of cutting edge 9 of cutting implement 8 as necessary to obtain the desired sharpening effect. When sharpener 10 is equipped with two sharpening blocks 210, one on each side of cutting edge 9, each sharpening block 210 may be drawn across cutting edge 9 in an alternating fashion, one at a time for a repeated number of strokes before applying the opposite sharpening block 210. The use of alternating sharpening blocks 210 has been shown to be a very efficient method of sharpening cutting implement 8. By using sharpening blocks 210 that progress from coarse grit to fine grit, the desired angle of the cutting edge 9 of cutting implement 8 is created or set.

In step 825, cutting edge 9 of cutting implement 8 is optionally polished or finished. Once the user feels a burr being created on one side of the cutting edge 9, the burr indicates that the ridge of the cutting edge 9 is rolling over and that the angle is created or set, at which point it is appropriate to begin polishing cutting edge 9 with sharpening blocks 210 of finer grit. Polishing the cutting edge 9 may also be done by using a sharpening block 210 having a leather strap embedded with a diamond paste or other abrasive. As a final polishing or finishing step, it is preferable in some embodiments of sharpening method 800 that the first angle 166 is altered by about 0.5 to 1 degree to achieve a better sharpening effect.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

I claim:

1. A sharpening apparatus comprising:

a base;

a first clamping member extending along a central clamp axis and pivotably supported by the base, the first clamping member having a first inside surface, a first proximal end portion, and a first distal end portion;

a second clamping member extending along the central clamp axis and pivotably supported by the base, the second clamping member extending in opposed alignment with the first clamping member and having a second inside surface facing and spaced apart from the first inside surface, a second proximal end portion, and a second distal end portion, wherein the first clamping member and the second clamping member are capable of pivoting to clamp a cutting implement between the first distal end portion and the second distal end portion;

a cam assembly attached to the base and comprising:

a cam shaft extending along a cam axis, the cam shaft rotatable between a first cam position and a second cam position;

a cam attached to the cam shaft, wherein rotating the cam shaft rotates the cam;

a follower disposed in operational engagement with the cam;

a wedge operatively coupled to the follower and disposed in movable engagement with the first proximal end portion of the first clamping member and the second proximal end portion of the second clamping member; and a spring between the follower and the wedge, wherein compressing the spring reduces a distance between the follower and the wedge;

wherein rotating the cam to the first cam position moves the wedge generally along the central clamp axis between and in engagement with the first proximal end portion and the second proximal end portion, thereby pivoting the first distal end portion and the second distal end portion towards each other; and wherein rotating the cam to the second cam position moves the wedge in an opposite direction generally along the central clamp axis, thereby enabling the first distal end portion and the second distal end portion to pivot away from each other.

2. The sharpening apparatus of claim 1 further comprising a clamp adjustment assembly configured to selectively move the cam assembly along the central clamp axis.

3. The sharpening apparatus of claim 2, wherein the clamp adjustment assembly comprises:

an adjustment body having a generally cylindrical shape and extending along an adjustment body axis parallel to and vertically spaced from the cam axis, wherein the adjustment body defines an outside surface eccentric about the adjustment body axis, and wherein the adjustment body is rotatable about the adjustment body axis between a first adjustment position and a second adjustment position; and a plurality of pins extending between the outside surface of the adjustment body and the cam shaft;

wherein rotating the adjustment body to the first position retracts the cam assembly from the first proximal end portion and the second proximal end portion, and wherein rotating the adjustment body to the second position advances the cam assembly along the central clamp axis towards the first proximal end portion and the second proximal end portion.

4. The sharpening apparatus of claim 3 further comprising:

a rod positioning assembly attached to the base and comprising:

a first arm extending longitudinally along a first axis perpendicular to a vertical plane between the first clamping member and the second clamping member, the first arm mounted to the base assembly and movable along the first axis;

a second arm extending longitudinally along a second axis parallel to the first axis, the second arm mounted to the base adjacent the first arm and movable along the second axis; and a rod positioning lever pivotably connected to the base and operatively connected to the first arm and to the second arm, wherein pivoting the rod positioning lever moves the first arm in a first direction along the first axis and moves the second arm in a second direction opposite of the first direction.

5. The sharpening apparatus of claim 4, wherein the rod positioning assembly further comprises:

a central pivot pin attached to the base, wherein the rod positioning lever is pivotable about the central pivot pin;

a first guide pin extending from the first arm and engaging the rod positioning lever to one side of the central pivot pin; and a second guide pin extending from the second arm and engaging the rod positioning lever to a second side opposite the central pivot pin from a first side.

6. The sharpening apparatus of claim 5, wherein the base comprises:

a first base plate with a top surface; and a second base plate disposed in a spaced apart and substantially parallel relation to the top surface of the first base plate;

wherein the first arm, the second arm, and the rod positioning lever are each at least partially disposed between the first base plate and the second base plate.

7. The sharpening apparatus of claim 6, wherein the base further comprises:

at least one support member having a proximal support member portion and a distal support member portion, the proximal support member portion connected at a proximal end to the second base plate and the distal support member portion extending transversely from the second base plate and pivotably connected to the first and second clamping members.

8. The sharpening apparatus of claim 3, further comprising:

a first guide rod having a proximal end and a distal end, wherein the proximal end is pivotably attached to the base;

a second guide rod having a proximal end and a distal end, wherein the proximal end of the second guide rod is pivotably attached to the base; and one or more abrasive implement holders each constructed to slidably move along the first guide rod or the second guide rod.

9. The sharpening apparatus of claim 1, further comprising:

a riser block below the first and second clamping members, the riser block defining a cam well extending into the riser block through a top of the riser block and receiving at least part of the cam therein, the riser block further defining a cam shaft opening through a sidewall of a cam block; and the cam shaft extending through the cam shaft opening, the cam shaft having a first end operatively connected to the cam within the riser block and having a second end connected to a handle outside of the riser block.

10. The sharpening apparatus of claim 1, wherein the first inside surface of the first clamping member defines a first sloped proximal end portion and the second inside surface of the second clamping member defines a second sloped proximal end portion diverging from the first sloped proximal end portion as the first sloped proximal end portion and the second sloped proximal end portion extend toward the base; and wherein the wedge is disposed in sliding engagement with the first sloped proximal end portion and the second sloped proximal end portion.

11. The sharpening apparatus of claim 1, wherein the wedge defines a recess that receives a portion of the spring.

12. A clamping apparatus comprising:

a first clamping member extending along a clamp central axis from a first proximal end portion to a first distal end portion and having a first inside surface;

a second clamping member extending along the clamp central axis from a second proximal end portion to a second distal end portion in opposed alignment with the first clamping member, the second clamping member having a second inside surface spaced from and facing the first inside surface, wherein the second distal end portion is opposite the first distal end portion and the second proximal end portion is opposite the first proximal end portion, and wherein a gap between the first inside surface of the first proximal end portion and the second inside surface of the second proximal end portion is adjustable to releasably secure a workpiece between the first inside surface of the first distal end portion and the second inside surface of the second distal end portion; and a clamp actuator with a handle, a spring, and a wedge, the spring between the clamp actuator and the wedge, the wedge movable along the clamp central axis between the first clamping member and the second clamping member in response to the handle moving between a first handle position and a second handle position, wherein compressing the spring reduces a distance between the clamp actuator and the wedge;

wherein moving the handle to the first handle position moves the wedge along the clamp central axis between and in engagement with the first inside surface of the first proximal end portion and in engagement with the second inside surface of the second proximal end portion, thereby increasing the gap; and wherein moving the handle to the second handle position moves the wedge in an opposite direction along the central clamp axis, thereby permitting the gap to decrease.

13. The clamping apparatus of claim 12, wherein the clamp actuator is a straight-line clamp with the wedge movable generally linearly along the clamp central axis and the handle pivotable about a first axis perpendicular to the clamp central axis.

14. The clamping apparatus of claim 12, wherein the clamp actuator includes a cam assembly with a cam and a follower operatively coupled to the wedge, wherein rotation of the cam moves the follower, the spring, and the wedge generally linearly along the clamp central axis.

15. The clamping apparatus of claim 14, wherein the cam assembly further comprises:

a cam shaft extending along a cam axis with the cam attached thereto, the cam shaft rotatable between a first cam position and a second cam position, wherein the follower is disposed in operational engagement with the cam, wherein the wedge is disposed in movable engagement with the first proximal end portion of the first clamping member and the second proximal end portion of the second clamping member;

wherein rotating the cam to the first cam position moves the wedge generally along the central clamp axis between the first clamping member and the second clamping member, thereby pivoting the first distal end portion and the second distal end portion towards each other; and wherein rotating the cam to the second cam position moves the wedge in an opposite direction along the clamp central axis.

16. The sharpening apparatus of claim 15 further comprising a clamp adjustment assembly configured to selectively change the position of the cam along the clamp central axis.

17. The sharpening apparatus of claim 16, wherein the clamp adjustment assembly comprises:

an adjustment body with a generally cylindrical shape extending along an adjustment body axis parallel to and spaced from the cam axis, wherein the adjustment body defines an outside surface eccentric about the adjustment body axis, and wherein the adjustment body is rotatable about the adjustment body axis between a first adjustment position and a second adjustment position; and a plurality of pins extending between the adjustment body and the cam shaft;

wherein rotating the adjustment body to the first adjustment position retracts the cam from the first clamping member and the second clamping member and rotating the adjustment body to the second adjustment position advances the cam toward the first clamping member and the second clamping member.

18. The sharpening apparatus of claim 12, further comprising:

a riser block below the first and second clamping members, the riser block defining a cam well extending into the riser block through a top of the riser block, the cam well receiving at least a portion of a cam therein, the riser block further defining a cam shaft opening through a sidewall of the riser block; and a cam shaft extending through the cam shaft opening, the cam shaft having a first end operatively connected to the cam within the riser block and a second end attached to the handle outside of the riser block.

19. The sharpening apparatus of claim 12, wherein the wedge defines a recess receiving a portion of the spring.

20. The sharpening apparatus of claim 12, wherein moving the handle to the first handle position advances the wedge between the first proximal end portion of the first clamping member and the second proximal end portion of the second clamping member, and wherein moving the handle to the second handle position retracts the wedge from between the first proximal end portion of the first clamping member and the second proximal end portion of the second clamping member.

21. A sharpening apparatus comprising:

a base;

a first clamping member extending along a central clamp axis and pivotably supported by the base, the first clamping member having a first inside surface, a first proximal end portion, and a first distal end portion;

a second clamping member extending along the central clamp axis and pivotably supported by the base, the second clamping member extending in opposed alignment with the first clamping member and having a second inside surface facing and spaced apart from the first inside surface, a second proximal end portion, and a second distal end portion, wherein the first clamping member and the second clamping member are capable of pivoting to clamp a cutting implement between the first distal end portion and the second distal end portion; and a cam assembly attached to the base and comprising:

a cam shaft extending along a cam axis, the cam shaft movable between a first cam position and a second cam position;

a cam attached to the cam shaft;

a follower disposed in operational engagement with the cam;

a wedge operatively coupled to the follower and disposed in movable engagement with the first proximal end portion of the first clamping member and the second proximal end portion of the second clamping member;

a spring between the follower and the wedge; and a clamp adjustment assembly configured to selectively move the cam assembly along the central clamp axis;

wherein moving the cam to the first cam position moves the wedge generally along the central clamp axis between and in engagement with the first proximal end portion and the second proximal end portion, thereby pivoting the first distal end portion and the second distal end portion towards each other; and wherein moving the cam to the second cam position moves the wedge in an opposite direction generally along the central clamp axis, thereby enabling the first distal end portion and the second distal end portion to pivot away from each other.

22. The sharpening apparatus of claim 21, wherein a bottom of the wedge defines a recess that receives a portion of the spring.

23. The sharpening apparatus of claim 21 further comprising:

a riser block below the first and second clamping members, the riser block defining a cam well extending into the riser block through a top of the riser block, the cam well receiving at least a portion of the cam therein, the riser block further defining a cam shaft opening through a sidewall of the riser block, wherein the cam shaft extends through the cam shaft opening and has a first end attached to the cam within the riser block.

24. The sharpening apparatus of claim 23 further comprising:

a handle attached to the cam shaft outside of the riser block.

* * * * *